US011846291B2

(12) United States Patent
Numata

(10) Patent No.: US 11,846,291 B2
(45) Date of Patent: Dec. 19, 2023

(54) BLOWER AND NOZZLE

(71) Applicant: MAKITA CORPORATION, Anjo (JP)

(72) Inventor: Fumitoshi Numata, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/464,770

(22) Filed: Sep. 2, 2021

(65) Prior Publication Data

US 2022/0099096 A1 Mar. 31, 2022

(30) Foreign Application Priority Data

Sep. 30, 2020 (JP) ..... 2020-166348

(51) Int. Cl.
*F04D 29/54* (2006.01)
*F04D 19/00* (2006.01)

(52) U.S. Cl.
CPC ..... *F04D 19/002* (2013.01); *F04D 29/547* (2013.01)

(58) Field of Classification Search
CPC ..... B08B 5/02; F04D 17/165; F04D 19/002; F04D 25/0673; F04D 25/084; F04D 29/547; F05D 2250/52
See application file for complete search history.

(56) References Cited

U.S. PATENT DOCUMENTS 4,848,007 A * 7/1989 Montagnino ..... A45D 20/122 34/97
5,157,757 A * 10/1992 McDougall ..... A45D 20/122 239/455
5,287,635 A * 2/1994 Chan ..... A45D 20/122 392/383
9,675,158 B2 * 6/2017 Soresina ..... A45D 20/12
D800,385 S * 10/2017 Porter ..... D28/24
D927,780 S * 8/2021 Carlucci ..... D28/18
2011/0307039 A1 * 12/2011 Cornell ..... A61F 7/0085 607/105
2017/0127804 A1 * 5/2017 Lee ..... A45D 44/16
2017/0245614 A1 * 8/2017 Porter ..... A45D 20/122
2017/0273425 A1 * 9/2017 Stephens ..... A45D 20/12
2018/0140070 A1 * 5/2018 Hillebrecht ..... A45D 20/124
2018/0184779 A1 * 7/2018 Torres ..... A45D 20/12
2019/0014879 A1 * 1/2019 deGrood ..... A45D 20/122
2019/0098979 A1 * 4/2019 Atkinson ..... A45D 20/122
2019/0104820 A1 * 4/2019 Williams ..... A45D 20/52
2020/0121053 A1 * 4/2020 Dawkins ..... A45D 20/122
2021/0307472 A1 * 10/2021 Conrad ..... A45D 20/50
2021/0330052 A1 * 10/2021 Lelieveld ..... A45D 44/00
2022/0032439 A1 * 2/2022 Numata ..... B08B 13/00
2022/0196035 A1 * 6/2022 Numata ..... F04D 17/165
2022/0305508 A1 * 9/2022 Numata ..... B05B 7/2429

FOREIGN PATENT DOCUMENTS

JP 2011-117442 A 6/2011
JP 2012-77817 A 4/2012

* cited by examiner

*Primary Examiner* — Aaron R Eastman
(74) *Attorney, Agent, or Firm* — Oliff PLC

(57) ABSTRACT

A blower includes a blower body and a nozzle. The blower body includes a housing having an inlet opening, a motor housed in the housing and at least one fan housed in the housing. The nozzle is connected to the blower body and extends in an axial direction. The nozzle has a discharge opening formed in its one end in the axial direction and at least one vent hole formed in a different position from the discharge opening.

19 Claims, 37 Drawing Sheets

BLOWER AND NOZZLE

CROSS REFERENCE TO RELATED ART

The present application claims priority to Japanese Patent Application No. 2020-166348 filed on Sep. 30, 2020, the disclosure of which is hereby incorporated by reference in its entirety.

TECHNICAL FIELD

The present disclosure relates to a blower including a blower body and a nozzle, and a nozzle.

RELATED ART

Blowers that are capable of discharging compressed air from a discharge opening are known. As an example of such blowers, Japanese Unexamined Patent Application Publication No. 2012-77817 discloses an air duster that includes an air duster body, which has an air compressing part and a motor within a housing that has a discharge opening and a inlet (suction) opening respectively formed on both ends thereof, and a nozzle connected to the discharge opening. Surge may occur depending on the structure of the blower. It is therefore desired to provide a novel technology for reducing the possibility of surge.

SUMMARY

According to a first aspect of the present disclosure, a blower is provided. The blower includes a blower body and a nozzle that is connected to the blower body and extends in an axial direction. The blower body includes a housing having an inlet opening, a motor housed in the housing and at least one fan housed in the housing. The nozzle has a discharge opening formed in a first end of the nozzle in the axial direction and at least one vent hole (at least one vent opening) formed in a different position from the discharge opening.

According to this aspect, the blower includes a nozzle having a discharge opening and at least one vent hole. Thus, the air blown out of the blower body is discharged not only from (through) the discharge opening but also from (through) the at least one vent hole. When the blower body is used with a nozzle having a relatively small discharge opening and not having a vent hole, surge may sometimes occur. According to this aspect, the possibility of surge can be reduced, owing to the air additionally discharged from the at least one vent hole. Further, owing to the structure of the nozzle, the possibility of surge can be reduced without need of changing the structure of the blower body.

According to a second aspect of the present disclosure, a nozzle is provided. The nozzle is configured to be connected to a blower body and extends in an axial direction. The blower body includes a housing having an inlet opening, a motor housed in the housing and at least one fan housed in the housing. The nozzle has a discharge opening formed in one end of the nozzle in the axial direction, and at least one vent hole (at least one vent opening) formed in a different position from the discharge opening.

According to this aspect, the nozzle discharges air blown out of the blower body not only from (through) the discharge opening but also from (through) the at least one vent hole. When the blower body is used with a nozzle having a relatively small discharge opening and not having a vent hole, surge may sometimes occur. According to this aspect, the possibility of surge can be reduced, owing to the air additionally discharged from the at least one vent hole. Further, owing to the structure of the nozzle, the possibility of surge can be reduced without need of changing the structure of the blower body.

DETAILED DESCRIPTION

Figure 1:
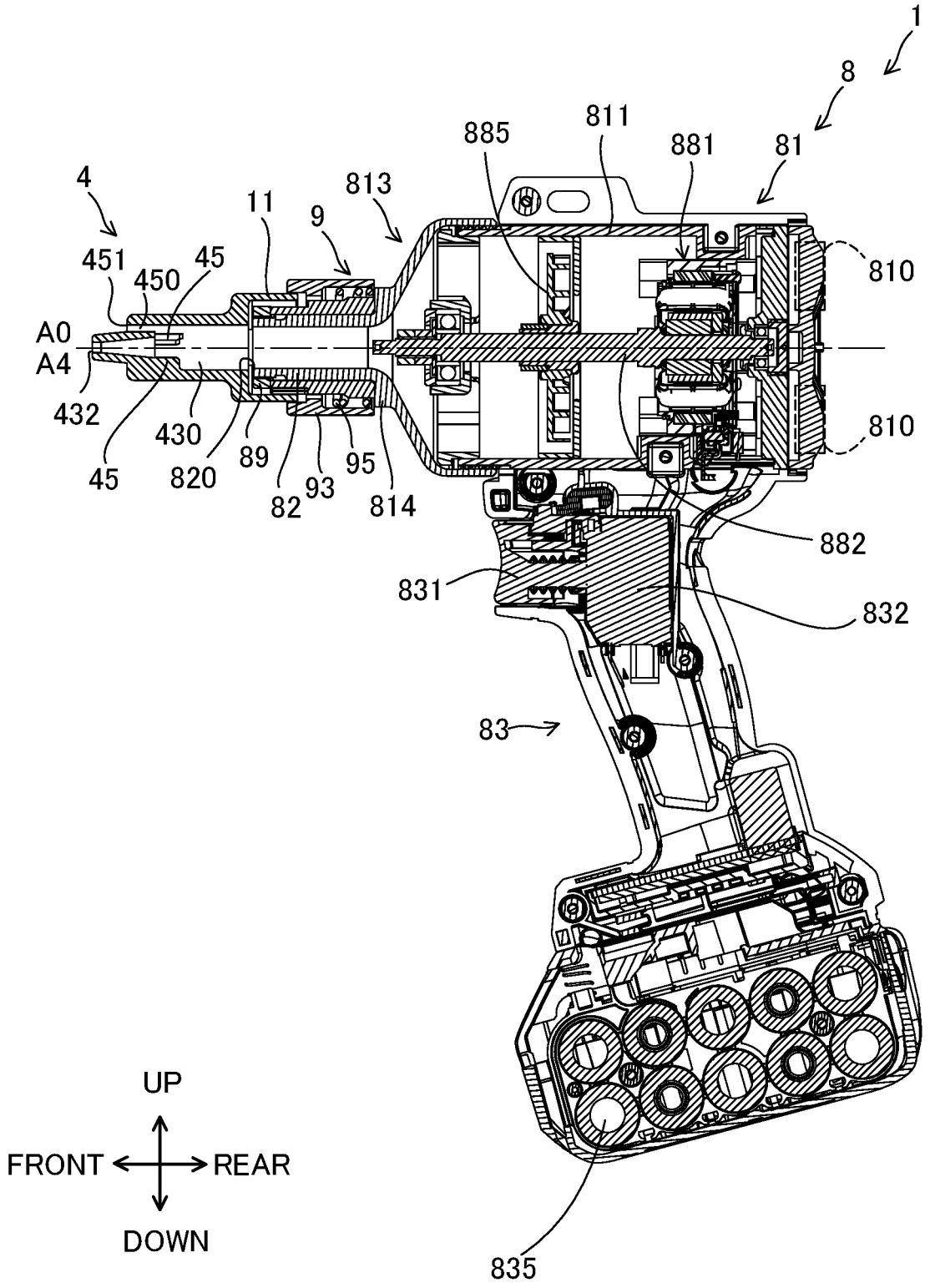
FIG. 1 is a schematic, sectional view of an air duster.

In one non-limiting embodiment of the present disclosure, a flow rate of the air discharged from (through) the discharge opening may be within a surge region (surge area) that is defined according to specifications of the blower body. Further, a total flow rate of the air discharged from (through) the at least one vent hole and from (through) the discharge opening may be outside the surge region.

According to this embodiment, surge can be prevented by provision of the at least one vent hole, even though the flow rate of the discharge opening is within the surge region.

In addition or in the alternative to the preceding embodiment, the at least one vent hole may be radially outward of the discharge opening.

According to this embodiment, arrangement of the at least one vent hole radially outward of the discharge opening can reduce the possibility of surge.

In addition or in the alternative to the preceding embodiments, the at least one vent hole may be open in the same direction as the discharge opening in the axial direction.

According to this embodiment, the at least one vent hole is open in the same direction as the discharge opening in the axial direction, so that the air discharged from the discharge opening and the air discharged from the vent hole flow in the same direction. Therefore, the air discharged from the discharge opening and the air discharged from the vent hole can be both blown to a target. Thus, the air discharged from the at least one vent hole can be effectively utilized.

In addition or in the alternative to the preceding embodiments, the nozzle may be shaped like hollow a conical cylinder having an outer diameter gradually decreasing toward the discharge opening. The at least one vent hole may be formed through a side portion (i.e., a cylindrical/tubular wall) of the hollow conical cylinder.

According to this embodiment, the air is discharged through the side portion of the nozzle, so that the effects of the air discharged from the at least one vent hole on a target can be reduced.

In addition or in the alternative to the preceding embodiments, the at least one vent hole may be formed in a side portion of the nozzle and extends to the first end of the nozzle such that the at least one vent hole communicates with the discharge opening.

According to this embodiment, with the structure in which the at least one vent hole is formed in the side portion of the nozzle and extend to the first end of the nozzle to communicate with the discharge opening, the possibility of surge can be reduced.

In addition or in the alternative to the preceding embodiments, the nozzle may have a passage that connects the blower body and the discharge opening. The discharge opening may be configured to receive a tubular projection. The tubular projection may be an air injection projection (air injection valve, air plug) formed on an inflatable object. A portion of the at least one vent hole may be configured to provide communication between an inside and an outside of the passage without being closed by the projection when the projection is inserted into the passage through the discharge opening. A flow rate of the air discharged into the inflatable object from the projection via the discharge opening may be within a surge region (surge area) that is defined according to specifications of the blower body. A total flow rate of the air discharged to the outside of the passage from the portion of the vent hole and the air discharged into the inflatable object from the projection via the discharge opening may be outside the surge region.

According to this embodiment, surge can be prevented when the air injection projection formed on the inflatable object is inserted into the passage from the discharge opening.

In addition or in the alternative to the preceding embodiments, the at least one vent hole may be between the discharge opening and the blower body in the axial direction.

According to this embodiment, the pressure of the air discharged from the at least one vent hole can be made lower than the pressure of the air discharged from the discharge opening. Therefore, compared with a structure in which a discharge opening and at least one vent hole are arranged in the same position in the axial direction, the effects of the air discharged from the vent hole on a target can be reduced.

In addition or in the alternative to the preceding embodiments, the at least one fan may be a single fan.

According to this embodiment, the possibility of surge can be reduced in the structure in which the blower body has a single fan.

In addition or in the alternative to the preceding embodiments, the nozzle may have a vent passage extending to the at least one vent hole. The nozzle may further include a ventilation resistance member (an airflow resistance member) removably disposed in the vent passage.

According to this embodiment, provision of the ventilation resistance member in the nozzle can prevent high-pressure air from being blown from the at least one vent hole to an unintended position.

In addition or in the alternative to the preceding embodiment, the nozzle may be removably attachable to the blower body.

According to this embodiment, a user can selectively attach and detach various kinds of nozzles to and from the blower body when using the blower.

In addition or in the alternative to the preceding embodiment, the blower may further include a lock mechanism. The lock mechanism may be configured to be actuated when the nozzle is moved in a first direction relative to the blower body in response to a user's manipulation of attaching the nozzle to the blower body. The lock mechanism may further be configured to lock (hold) the nozzle in (at) an attachment position to be immovable in a second direction opposite to the first direction when the nozzle is placed in (at) the attachment position relative to the blower body.

According to this embodiment, the lock mechanism can be actuated to lock the nozzle to be immovable in the second direction in response to the simple user's manipulation of only moving the nozzle in the first direction to the attachment position relative to the blower body. Operability (maneuverability) can be therefore improved, compared with a structure in which the nozzle is required to be operated in two directions.

The technology of this disclosure can be realized not only in the form of a blower but also in various other devices or applications, such as a nozzle to be connected to a blower body and a connecting structure between a blower body and a nozzle.

First to sixth representative and non-limiting embodiments of the present disclosure are now specifically described with reference to the drawings.

First Embodiment

An air duster 1 according to the first embodiment of the present disclosure is described with reference to FIGS. 1 to 14. The air duster 1 is a non-limiting, exemplary embodiment of an electric blower.

The air duster 1 is a kind of blower (air blower) that is capable of blowing off grit, dust, etc. by discharging compressed air. As shown in FIG. 1, the air duster 1 includes an air duster body 8 and a nozzle 4. In this embodiment, the nozzle 4 is additionally attached to a nozzle part 82 of the air duster body 8 to be used with the air duster body 8. Various kinds of nozzles can be selectively attached to the nozzle part 82 of the air duster body 8. A user can use the air duster body 8 without a nozzle or with an appropriate nozzle attached thereto, depending on an operation to be performed. The nozzle 4 of this embodiment is an example of the nozzles that can be attached to the air duster body 8.

The structure of the air duster body 8 is first outlined.

The air duster body 8 includes a body housing 81 and a handle 83. A motor 881 and a single centrifugal fan 885 are housed in the body housing 81. An output shaft 882 of the motor 881 and the centrifugal fan 885 are integrally driven around a rotational axis A0. The body housing 81 extends along the rotational axis A0. Openings (inlet openings) 810 for sucking air into the body housing 81 are formed in one axial end portion of the body housing 81. The nozzle part 82 is formed in the other axial end portion of the body housing 81. The nozzle part 82 has a hollow cylindrical shape centering on the rotational axis A0 and has an opening (discharge opening) 820 for discharging air from the body housing 81. The discharge opening 820 has a diameter of 13.0 mm. The handle 83 is configured to be held by a user. The handle 83 protrudes from the body housing 81 and extends in a direction that crosses the rotational axis A0.

In the following description, for convenience sake, the extending direction of the rotational axis A0 is defined as a front-rear direction of the air duster body 8. In the front-rear direction, a direction from the inlet openings 810 toward the discharge opening 820 is defined as a forward direction, while the opposite direction (from the discharge opening 820 toward the inlet openings 810) is defined as a rearward direction. A direction that is orthogonal to the rotational axis A0 and that generally corresponds to the extending direction of the handle 83 is defined as an up-down direction of the air duster body 8. In the up-down direction, a direction in which the handle 83 protrudes from the body housing 81 (the direction from the body housing 81 toward a protruding end of the handle 83) is defined as a downward direction, while the opposite direction (from the protruding end of the handle 83 toward the body housing 81) is defined as an upward direction. A direction that is orthogonal to both the front-rear direction and the up-down direction is defined as a left-right direction.

A trigger 831 is provided in an upper end portion of the handle 83. A switch 832 is housed within the handle 83. A battery 835 for supplying power to the motor 881 is removably coupled to a lower end portion of the handle 83. When the trigger 831 is depressed by the user, the switch 832 is turned on and the motor 881 is driven. The centrifugal fan 885 is then rotationally driven, so that air is sucked into the body housing 81 through the inlet openings 810. The air is compressed by the centrifugal fan 885 and discharged from the discharge opening 820. When the nozzle 4 is attached to the air duster body 8, the air discharged from the discharge opening 820 passes through passages 430, 440 (see FIG. 4) of the nozzle 4 and is discharged from a discharge opening 432 of the nozzle 4.

The structure of the nozzle 4 is now described in detail.

Figure 2:
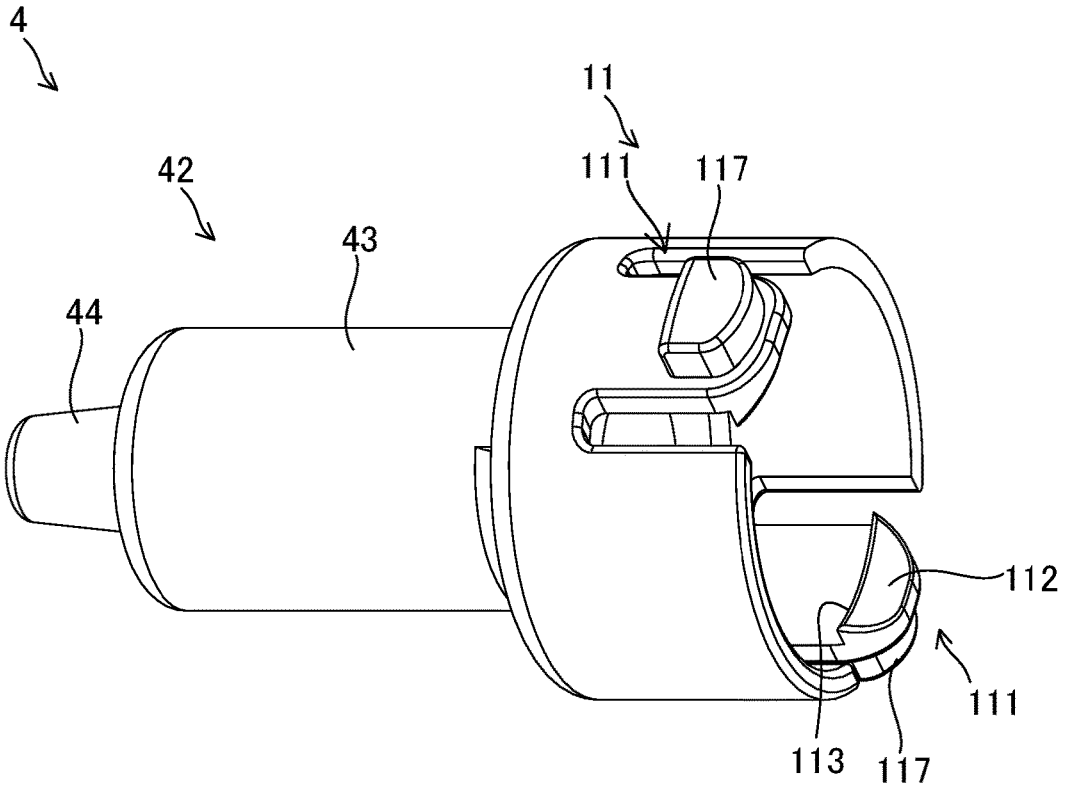
FIG. 2 is a perspective view of a nozzle according to a first embodiment.

As shown in FIG. 2, the nozzle 4 includes a mounting part 11 and a body part 42. The mounting part 11 is configured to be attached (coupled, connected, mounted) to the nozzle part 82 (specifically, to a lock mechanism 9; see FIG. 1) of the air duster body 8. The body part 42 is connected to the mounting part 11. The mounting part 11 and the body part 42 are integrally formed of synthetic resin (polymer).

In the following description, for convenience sake, the direction of the nozzle 4 is defined with reference to the orientation of the nozzle 4 attached to the air duster body 8. The nozzle 4 is attached to the air duster body 8 such that an axis of the mounting part 11 coincides with the rotational axis A0. Thus, an extending direction of an axis A4 of the nozzle 4 (an axial direction of the mounting part 11) is defined as a front-rear direction of the nozzle 4. In the front-rear direction, the side on which the mounting part 11 is located (the side to be connected to the air duster body 8) is a rear side of the nozzle 4, and the side on which the body part 42 is located is a front side of the nozzle 4.

As shown in FIGS. 1 to 4, the mounting part 11 has a generally hollow cylindrical shape. The mounting part 11 has a pair of (two) locking pieces 111 configured to engage with the lock mechanism 9 (see FIG. 1). The locking pieces 111 are arranged in symmetry across the axis A4 and extend in the axial direction. Each of the locking pieces 111 is defined between two slits each extending forward from a rear end of the mounting part 11. Thus, a rear end of the locking piece 111 is a free end, so that the locking piece 111 can elastically deform in a radial direction of the nozzle 4, with its front end serving as a pivot point.

Figure 4:
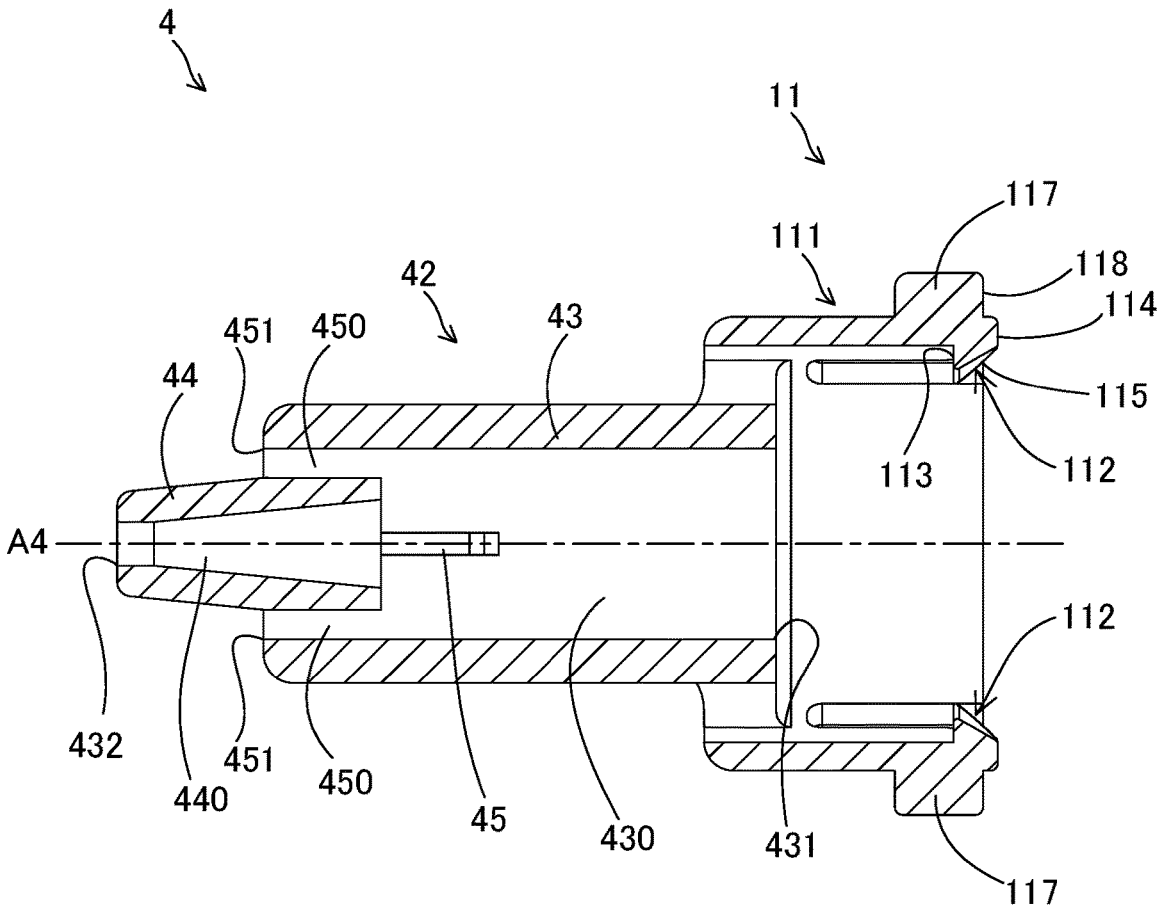
FIG. 4 is a sectional view taken along line IV-IV in FIG. 3.

The rear end portion of the locking piece 111 has a claw (locking projection) 112. The claw 112 protrudes radially inward from the rear end of the locking piece 111. As shown in FIG. 4, the claw 112 has a front end surface 113, a rear end surface 114 and an inclined surface 115. The front and rear end surfaces 113, 114 extend generally perpendicular to the axis A4 of the nozzle 4. The inclined surface 115 is a surface connecting a radially inner end of the front end surface 113 and a radially inner end of the rear end surface 114 and inclined radially outward toward the rear.

The rear end portion of the locking piece 111 further has an actuation projection 117. The actuation projection 117 protrudes radially outward from an outer surface of the rear end portion. A center of the actuation projection 117 in a circumferential direction is positioned to coincide with a center of the claw 112 in a circumferential direction. The actuation projection 117 is arranged slightly forward of the claw 112, and a rear end of the actuation projection 117 is located slightly forward of the rear end of the rear end portion (the rear end surface 114 of the claw 112). The actuation projection 117 has a rear end surface 118 that is U-shaped with its central portion protruding rearward when viewed from radially outside. Thus, the rear end surface 118 of the actuation projection 117 is a curved surface.

The detailed structure of the nozzle part 82 (the lock mechanism 9) of the air duster body 8 and attachment/detachment of the mounting part 11 to/from the nozzle part 82 will be described below.

Figure 3:
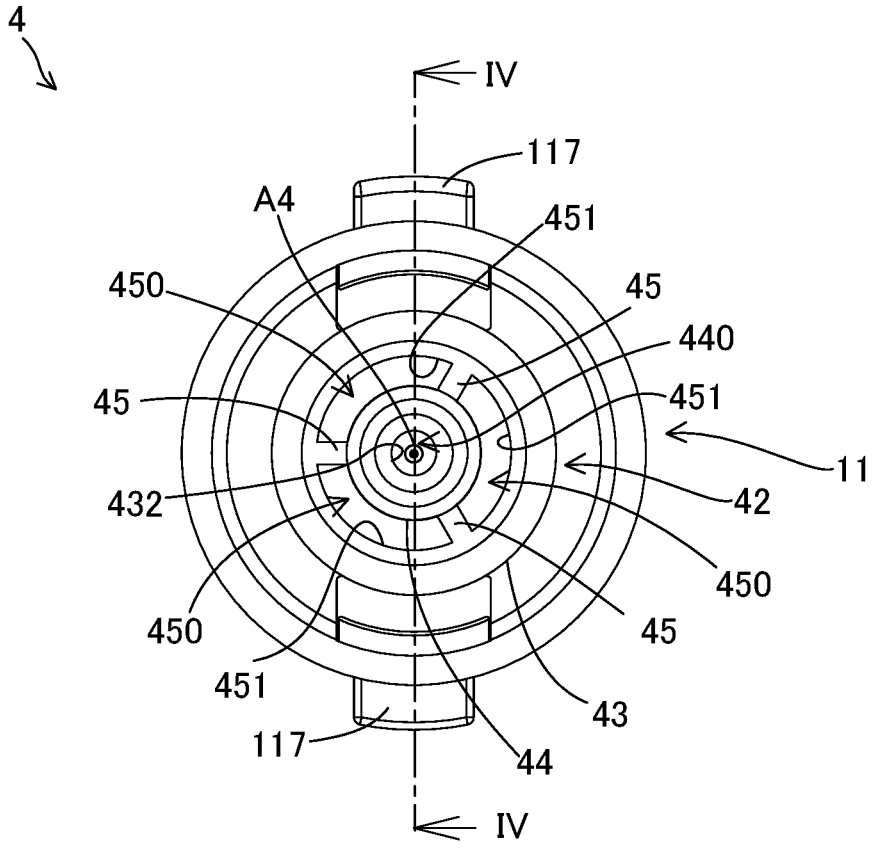
FIG. 3 is a front view of the nozzle.

As shown in FIGS. 2 to 4, the body part 42 protrudes forward along the axis A4 of the nozzle 4 from a front end of the mounting part 11. The body part 42 includes a first cylindrical wall (tubular wall) 43 and a second cylindrical wall (tubular wall) 43 that are coaxially arranged.

The first cylindrical wall 43 forms a hollow cylindrical portion that extends forward from the mounting part 11. A rear end of the first cylindrical wall 43 is connected to the mounting part 11. The outer and inner diameters of the first cylindrical wall 43 are substantially uniform in the axial direction. The first cylindrical wall 43 defines a passage 430 extending in the front-rear direction along the axis A4. A rear end opening of the first cylindrical wall 43 (a rear end inlet opening of the passage 430) is also referred to as an inlet opening 431. A front end opening of the first cylindrical wall 43 is perpendicular to the axis A4. Thus, the front end opening of the first cylindrical wall 43 faces forward.

The second cylindrical wall 44 forms a hollow, generally conical cylindrical portion extending forward from a front end region of the first cylindrical wall 43. Front and rear end openings of the second cylindrical wall 44 are perpendicular to the axis A4. The outer diameter of the second cylindrical wall 44 is smaller than the inner diameter of the first cylindrical wall 43. A rear end portion of the second cylindrical wall 44 is disposed within (radially inward of) a front end portion of the first cylindrical wall 43. A portion of the second cylindrical wall 44 that extends forward from the rear end portion of the second cylindrical wall 44 has outer and inner diameters that gradually decrease toward the front. The second cylindrical wall 44 defines the passage 440. The front end opening of the second cylindrical wall 44 is also referred to as a discharge opening 432. In this embodiment, the discharge opening 432 has a diameter of 3.0 mm.

In this embodiment, three connecting parts 45 are disposed between an inner surface of the first cylindrical wall 43 and an outer surface of the second cylindrical wall 44, and connect the first and second cylindrical walls 43 and 45. The three connecting parts 45 extend in the axial direction and are equally spaced in the circumferential direction. Thus, the inner surface of the first cylindrical wall 43, the outer surface of the second cylindrical wall 44 and the three connecting parts 45 define three vent passages 450 in the front end portion of the first cylindrical wall 43, and further define three openings at a front end of the first cylindrical wall 43. These openings are also referred to as vent holes (vent openings) 451.

Thus, the nozzle 4 has the vent holes 451 formed in (at) different positions from the discharge opening 432. In this embodiment, the vent holes 451 are disposed between the discharge opening 432 and the air duster body 8 in the axial direction (the front-rear direction) and radially outward of the discharge opening 432. Further, like the discharge opening 432, the vent holes 451 are open to the front and are in parallel to the discharge opening 432. It is noted that the vent holes 451 are not required to be at the same position as the discharge opening 432 in the axial position, and may be at any position in the axial direction, as long as the vent holes 451 are radially outward of the discharge opening 432.

With such a structure, the air blown out of the air duster body 8 by the centrifugal fan 885 flows into the nozzle 4 from the inlet opening 431, flows through the passages 430 and 440, and is discharged from (through) the discharge opening 432. The air flowing in through the inlet opening 431 also flows through the passage 430 and the vent passages 450, and is discharged from (through) the vent holes 451.

The vent holes 451 are configured to have a function of preventing occurrence of surge in the air duster 1. Surge is a phenomenon that a pressure and a flow rate of air in a piping pulsate (oscillate) periodically when the air duster 1 or a compressor connected to the piping is operated to discharge air at a lower flow rate than a regular rate. The characteristic of a blower is generally expressed by a characteristic curve (also referred to as a performance curve or a pressure curve) plotted on a graph in which the horizontal axis (x-axis) and the vertical axis (y-axis) respectively represent a flow rate and a static pressure of air discharged from the blower. It is known that surge occurs when the air duster 1 operates in a region (area) in which the characteristic curve extends upward and rightward (in a region in which the static pressure decreases as the flow rate decreases). This region is hereinafter referred to as a surge region (surge area). In the above-described graph, the surge region is a region on the left side of a boundary that is defined according to specifications of the blower. This boundary is also referred to as a surge line. The flow rate of the air discharged from the blower refers, for example, to a flow rate of air discharged from a discharge opening of a nozzle connected to the air duster body 8.

In this embodiment, the discharge opening 820 of the air duster body 8 has a diameter of 13.0 mm, while the discharge opening 432 of the nozzle 4 has a diameter of 3.0 mm. The surge region is defined according to specifications of the air duster body 8 (e.g. specifications of the body housing 81, the motor 881 and the centrifugal fan 885). Further, it is known that, when the air duster body 8 is connected to a piping that has a discharge opening having a diameter of 3.0 mm and operated, a flow rate of air discharged from (through) the discharge opening falls within the surge region in the above-described graph. Therefore, in this embodiment, as shown in FIGS. 1, 3 and 4, the vent holes 451 are provided in the nozzle 4 in addition to the discharge opening 432. The vent holes 451 are arranged in positions that are different from that of the discharge opening 432 and let the air out of the nozzle 4, such that the total flow rate of the air discharged from the nozzle 4 is increased to prevent surge. The flow rate to be increased (i.e., the flow rate of the air to be discharged from the vent holes 451) to prevent surge can be specified based on the characteristic curve of the air duster body 8 and the surge region (surge line). Further, the required increase of the flow rate can be realized by properly setting (increasing) the area of the vent holes 451. Thus, provision of the vent holes 451 increases the total flow rate of the air discharged from the nozzle 4, such that the total flow rate is out of the surge region, thereby preventing surge.

The relation between surge and the flow rate of the air discharged from the discharge opening 432 and the vent holes 451 is now described in further detail. In this embodiment, the flow rate of the air discharged only from the discharge opening 432 of the nozzle 4 is within a surge region that is defined according to the specifications of the air duster body 8 (hereinafter simply referred to as "within the surge region") when a nozzle not having a vent hole and having a discharge opening having the same area as the discharge opening 432 of the nozzle 4 is connected to the air duster body 8. The vent holes 451 of the nozzle 4 are configured such that the total flow rate of the air discharged from the discharge opening 432 and from the three vent holes 451 of the nozzle 4 is outside the surge region defined according to the specifications of the air duster body 8 (hereinafter simply referred to as "outside the surge region").

Thus, the nozzle 4 of this embodiment does not cause surge when the air duster 1 is operated with the nozzle 4 connected to the air duster body 8. Further, if the vent holes 451 are closed and the air is not discharged from the vent holes 451, the nozzle 4 causes surge.

The structures of the nozzle part 82 and the lock mechanism 9 of the air duster body 8 are now described.

As shown in FIG. 1, the body housing 81 of the air duster body 8 includes a hollow cylindrical part 811 and a front cover 813 connected to a front end portion of the cylindrical part 811. In this embodiment, the front cover 813 is separately formed from the cylindrical part 811. The front cover 813 is threadedly engaged with the front end portion of the cylindrical part 811 and covers a front end opening of the cylindrical part 811. The front cover 813 has a tapered funnel shape (hollow conical cylindrical shape) as a whole. The nozzle part 82 is a hollow cylindrical front end portion of the front cover 813. The lock mechanism 9 is mounted on (around) the nozzle part 82. The nozzle 4 can be attached (coupled, connected, mounted) to and detached (decoupled, removed) from the nozzle part 82 via the lock mechanism 9.

Figure 5:
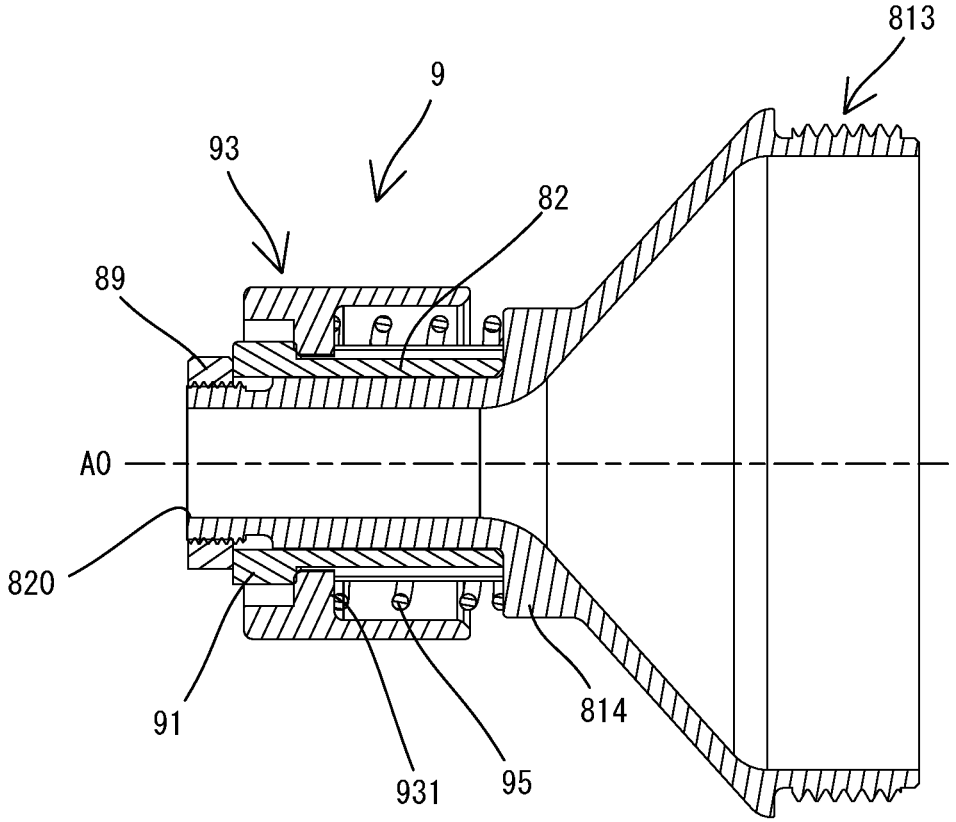
FIG. 5 is a sectional view of a lock mechanism.

The lock mechanism 9 is now described. The lock mechanism 9 is configured to lock the nozzle 4 to the air duster body 8 in (at) a prescribed attachment position. As shown in FIG. 5, the lock mechanism 9 includes a lock sleeve 91 that is fixed to the air duster body 8, a slide sleeve 93 that is movable relative to the lock sleeve 91 only in the front-rear direction, and a biasing spring 95 that biases the slide sleeve 93 forward relative to the lock sleeve 91.

As shown in FIGS. 5 to 9, the lock sleeve 91 has a hollow cylindrical shape. The lock sleeve 91 is coaxially fitted around the nozzle part 82 of the front cover 813 and fixed to the front cover 813 with a nut 89.

The lock sleeve 91 is configured to engage with the nozzle 4. More specifically, the outer diameter of the lock sleeve 91 is substantially equal to the inner diameter (the inner diameter of a portion excluding the claws 112) of the mounting part 11 (see FIG. 4) of the nozzle 4. A pair of (two) locking grooves 913 are formed in the outer peripheral surface of the lock sleeve 91. The locking grooves 913 are arranged in symmetry across the axis of the lock sleeve 91. Each of the locking grooves 913 is a recess that is recessed radially inward from the outer peripheral surface of the lock sleeve 91 and that extends in the circumferential direction around the axis. The locking groove 913 is configured to engage with the claw 112 of the locking piece 111 of the nozzle 4.

Guide parts 915 are respectively provided in front of the locking grooves 913. The guide part 915 is configured to smoothly guide the claw 112 of the locking piece 111 to the corresponding locking groove 913. The guide part 915 is a recess that is recessed radially inward from the outer peripheral surface of the lock sleeve 91 and that extends from the front end of the lock sleeve 91 to a vicinity of the front end of the locking groove 913. The guide part 915 has an inclined surface 916 gently inclined radially outward toward the rear.

A release groove 917 is connected to one end portion of the locking groove 913 in the circumferential direction. More specifically, the release groove 917 extends continuously from one end portion of the locking groove 913 that is on a clockwise side in the circumferential direction when the lock sleeve 91 is viewed from the front. The release groove 917 is a recess that has substantially the same depth as the locking groove 913 and that extends linearly forward to the front end of the lock sleeve 91. The release groove 917 thus has an open front end. The release groove 917 is provided to release the claw 112 of the locking piece 111 from the locking groove 913 (that is, to allow forward movement of the nozzle 4). The circumferential width of the release groove 917 is slightly larger than the width of the claw 112 of the locking piece 111.

Figure 6:
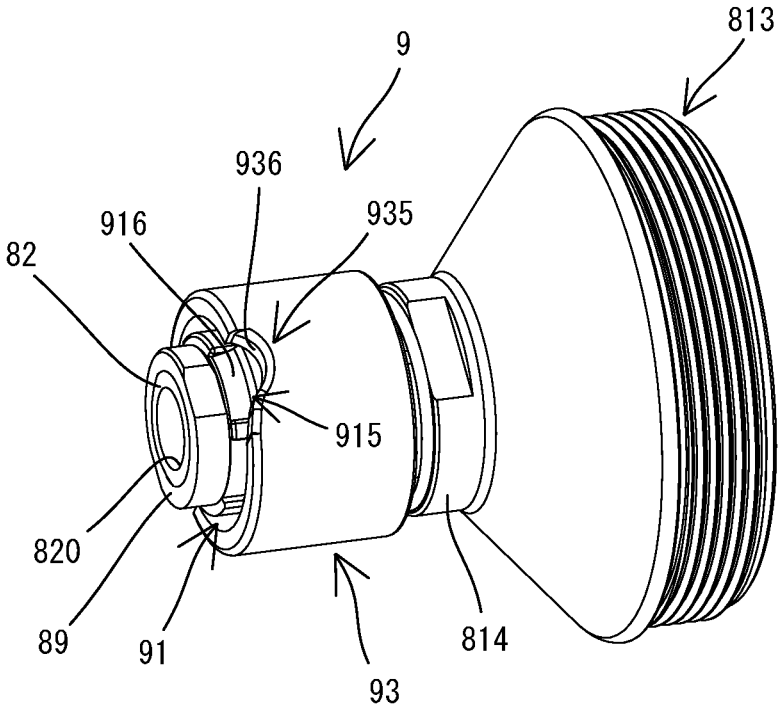
FIG. 6 is a perspective view of a front cover and the lock mechanism.
Figure 10:
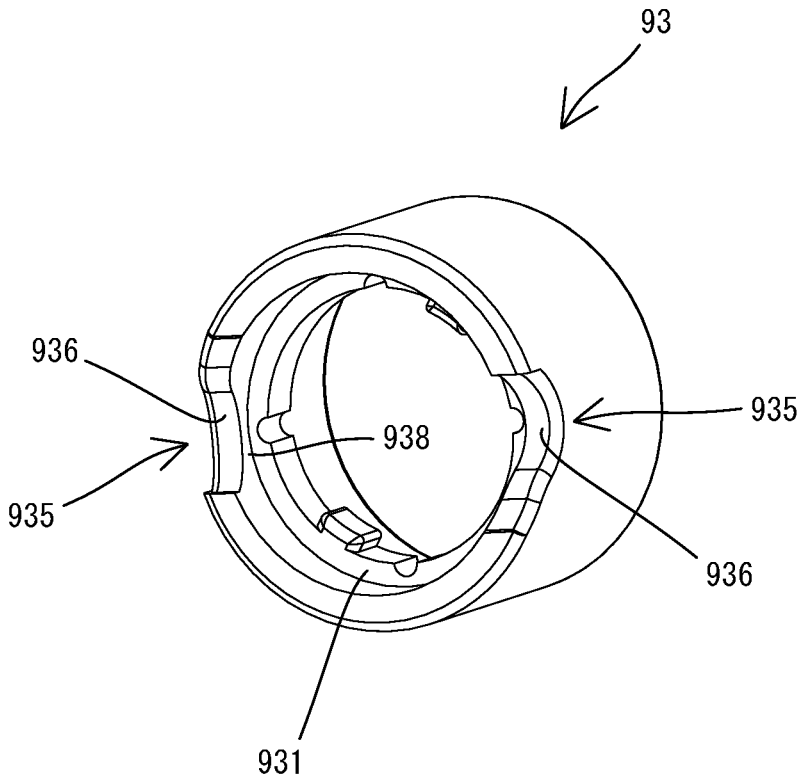
FIG. 10 is a perspective view of a slide sleeve.

As shown in FIGS. 5, 6 and 10, the slide sleeve 93 has a hollow cylindrical shape. The slide sleeve 93 is arranged radially outward of (around) the lock sleeve 91 and held (supported) to be movable relative to the lock sleeve 91 only in the axial direction (the front-rear direction).

The slide sleeve 93 has a pair of (two) receiving recesses 935 each configured to engage with the actuation projection 117 (see FIG. 4) formed on the mounting part 11 of the nozzle 4. The receiving recesses 935 are arranged in symmetry across an axis of the slide sleeve 93. Each of the receiving recesses 935 is recessed rearward from a front end of the slide sleeve 93 and has a U-shape generally conforming to the actuation projection 117 of the nozzle 4 when viewed from radially outside. A surface that defines the receiving recess 935 is an abutment surface (contact surface) 936, which is a curved surface configured to abut on (contact) the rear end surface 118 of the actuation projection 117.

As shown in FIG. 5, the biasing spring 95 is disposed between the lock sleeve 91 and the slide sleeve 93 in the radial direction. The biasing spring 95 of this embodiment is a compression coil spring. The biasing spring 95 is disposed in a compressed state between a spring receiving part 931 formed on the inside of the slide sleeve 93 and a shoulder part 814 formed on the front cover 813 behind the nozzle part 82. The biasing spring 95 always biases the slide sleeve 93 forward, so that the slide sleeve 93 is held in (at) a front position in an initial state where the nozzle 4 is not coupled to the lock mechanism 9. Further, the receiving recesses 935 of the slide sleeve 93 are positioned radially outward of the guide parts 915 of the lock sleeve 91, respectively.

Operation of the lock mechanism 9 is now described.

First, operation of the lock mechanism 9 in attachment of the nozzle 4 to the air duster body 8 is described.

When attaching the nozzle 4 to the air duster body 8, the user moves the nozzle 4 linearly rearward toward the air duster body 8. This manual operation (manipulation) performed on the nozzle 4 by the user is hereinafter also referred to as attaching operation. More specifically, the user properly adjusts the circumferential position of the nozzle 4 relative to the lock mechanism 9 and pushes the nozzle 4 into the lock mechanism 9 along the rotational axis A0 from the front. As a mark for positioning the nozzle 4, the actuation projection 117 formed on the outer surface of the locking piece 111 of the nozzle 4 (see FIGS. 2 to 4) and the receiving recess 935 of the slide sleeve 93 (see FIG. 10) can be used. Aligning the actuation projection 117 with the receiving recess 935 in the circumferential direction is equivalent to aligning the claw 112 with the guide part 915 and thus with the locking groove 913.

Figure 8:
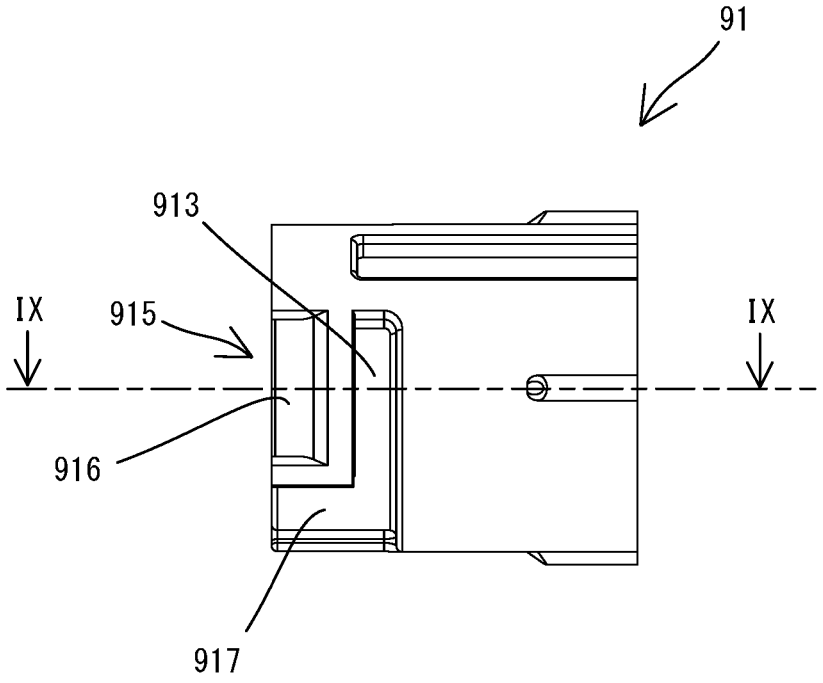
FIG. 8 is a side view of the lock sleeve.
Figure 9:
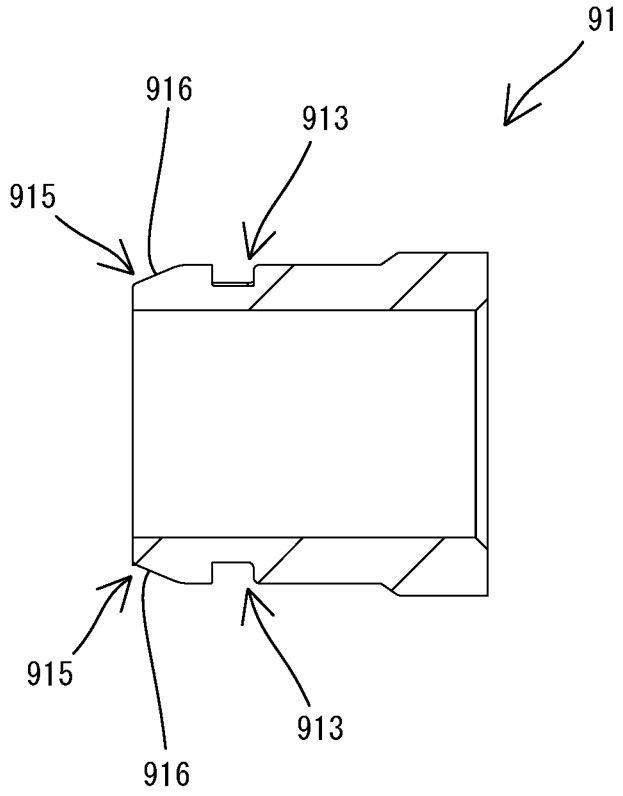
FIG. 9 is a sectional view taken along line IX-IX in FIG. 8.
Figure 11:
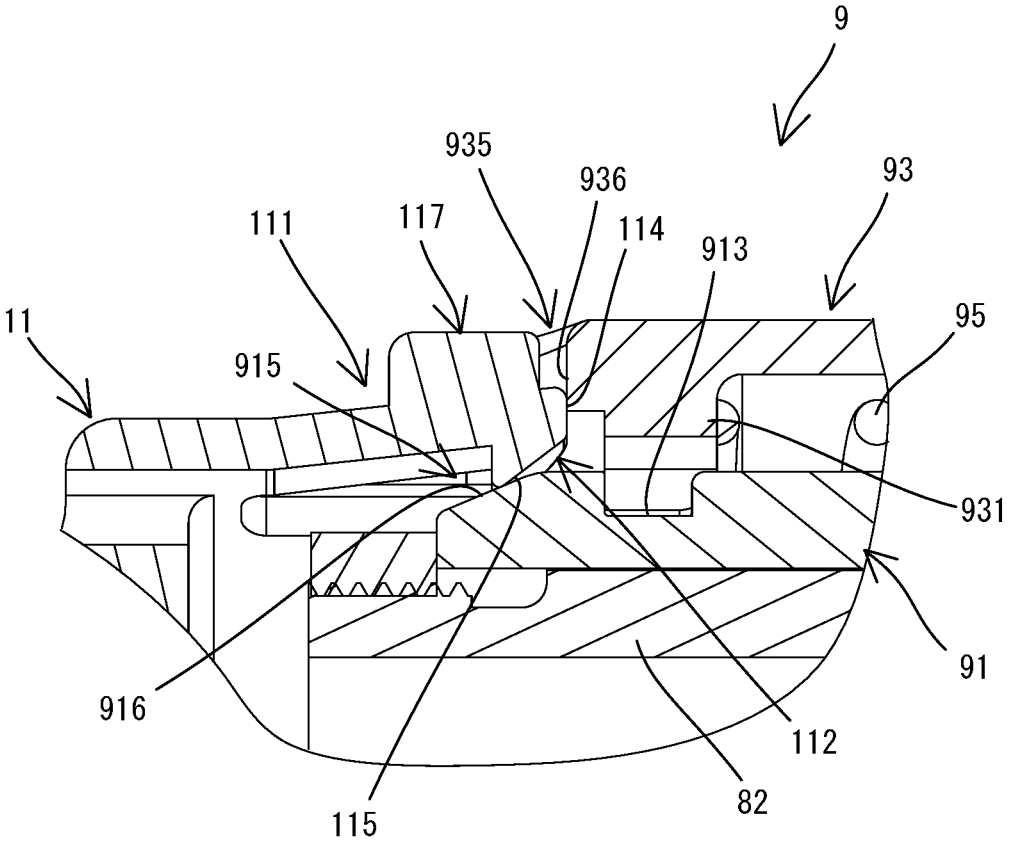
FIG. 11 is an explanatory drawing for illustrating operation of the lock mechanism in a process of attaching the nozzle to the air duster.

When the user pushes the nozzle 4 onto (into) the lock mechanism 9, the claws 112 of the locking pieces 111 abut on the guide parts 915 of the lock sleeve 91 (see FIG. 8). More specifically, the inclined surface 115 of the claw 112 abuts on the inclined surface 916 of the guide part 915, respectively. When the nozzle 4 is moved rearward in this state, the locking piece 111 elastically deforms such that its locking end moves radially outward. When the user further pushes (moves) the nozzle 4 rearward, as shown in FIG. 11, the rear end surfaces 114 of the claws 112 abut on (come into contact with) the abutment surfaces 936 of the receiving recesses 935 of the slide sleeve 93, respectively, and move the slide sleeve 93 rearward relative to the lock sleeve 91 against the biasing force of the biasing spring 95. The mounting part 11 of the nozzle 4 (excluding the locking pieces 111) enters a gap between the lock sleeve 91 and the slide sleeve 93.

Figure 12:
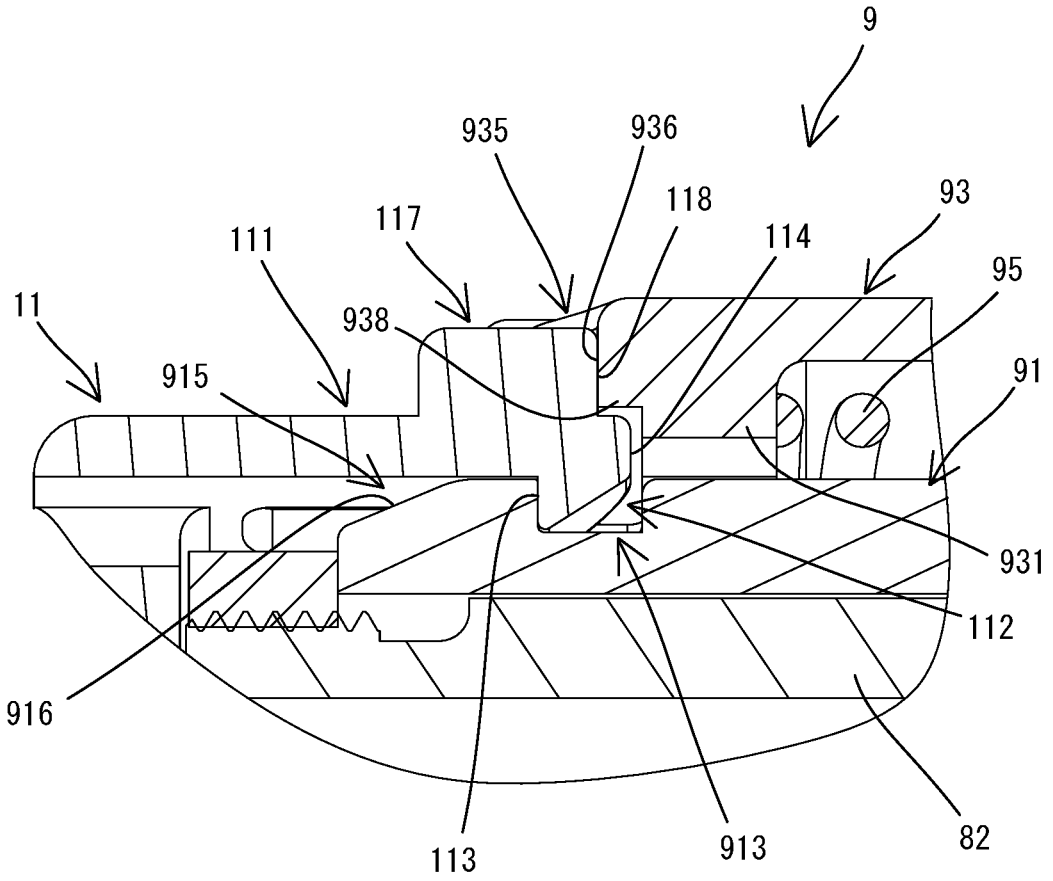
FIG. 12 is an explanatory drawing for illustrating the lock mechanism when the nozzle is placed in an attachment position.

When the claws 112 climb onto the outer peripheral surface of the lock sleeve 91 via the inclined surfaces 916 of the guide parts 915 and reach the locking grooves 913, respectively, as shown in FIG. 12, the claws 112 move radially inward by the restoring force of the locking pieces 111 and return to their initial positions to be engaged with the locking grooves 913, respectively. At this time, the rear end surfaces 114 of the claws 112 are separated (disengaged) from the corresponding abutment surfaces 936 of the receiving recesses 935 and thus release (stop) rearward pressing of the slide sleeve 93. Consequently, the slide sleeve 93 is moved forward by the biasing force of the biasing spring 95 and held in (at) a position (hereinafter referred to as a locking position) in (at) which the abutment surfaces 936 of the receiving recesses 935 respectively abut on the rear end surfaces 118 of the actuation projections 117 of the nozzle 4. Specifically, the slide sleeve 93 is held with the actuation projections 117 respectively fitted (engaged) in the receiving recess 935.

As shown in FIG. 12, when the slide sleeve 93 is placed in the locking position, a portion (a wall portion) of the slide sleeve 93 between the rear end (the deepest portion of each receiving recess 935 and the front end of the spring receiving part 931 is located radially outward of the rear end portion (the claw 112) of the locking piece 111. This wall portion functions as a restricting part 938, which restricts elastic deformation of the locking piece 111 in such a direction that the claw 112 is disengaged from the locking groove 913 and thereby keeps the claw 112 engaged with the locking groove 913. Further, as shown in FIG. 13, the receiving recesses 935 are engaged with the actuation projections 117 while the slide sleeve 93 is biased forward, so that rotational (pivotal) movement of the nozzle 4 around the rotational axis A0 is restricted.

In this manner, the lock mechanism 9 locks the nozzle 4 so as not to move forward, in a (at) position in (at) which the claws 112 are respectively engaged with the locking grooves 913. The position of the nozzle 4 at this time is hereinafter also referred to as the attachment position. The lock mechanism 9 further restricts rotation of the nozzle 4 placed in the attachment position.

Operation of the lock mechanism 9 in detachment of the nozzle 4 from the air duster body 8 is now described.

Figure 13:
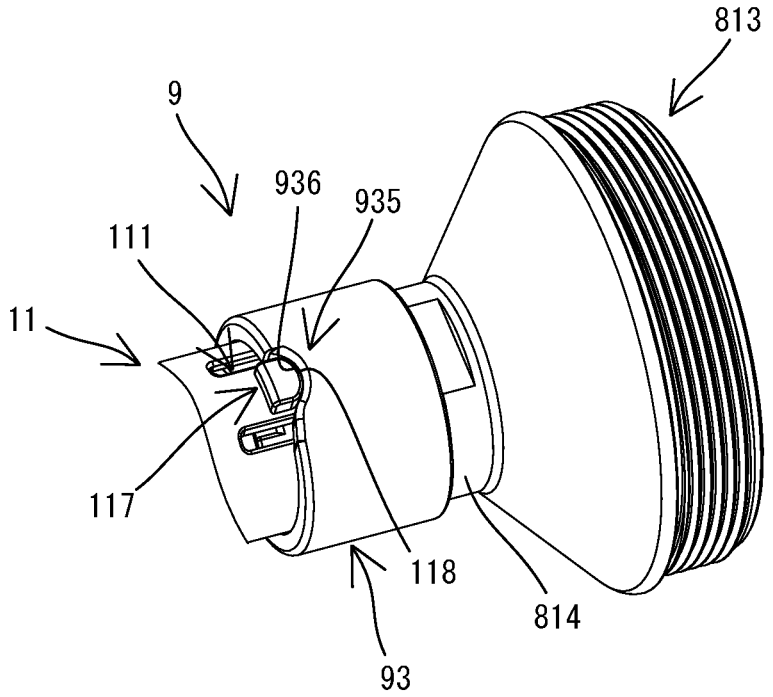
FIG. 13 is a perspective view of the lock mechanism when the nozzle is placed in the attachment position.

When detaching the nozzle 4 locked (held) in the attachment position as shown in FIG. 13 from the air duster body 8, the user first turns (rotates, pivots) the nozzle 4 relative to the air duster body 8 around the axis of the nozzle 4 so as to release locking of (unlock) the lock mechanism 9. This manual operation (manipulation) of turning the nozzle 4 performed by the user is hereinafter also referred to as an unlocking operation. More specifically, the user holds the nozzle 4 and turns the nozzle 4 around the rotational axis A0 in the clockwise direction as viewed from the front. As described above, the slide sleeve 93 is biased forward in a non-rotatable state, and the actuation projections 117 are respectively fitted in (engaged with) the receiving recess 935. When the user turns the nozzle 4 against the biasing force of the biasing spring 95, the circumferential force is converted into an axial force and acts upon the slide sleeve 93 to move the slide sleeve 93 rearward, by cooperation between an end portion of the rear end surface 118 (curved surface) of each actuation projection 117 on the turning direction side (the clockwise direction side in the circumferential direction as viewed from the front) and an end portion of the abutment surface 936 (curved surface) of each receiving recess 935 on the turning direction side.

Figure 7:
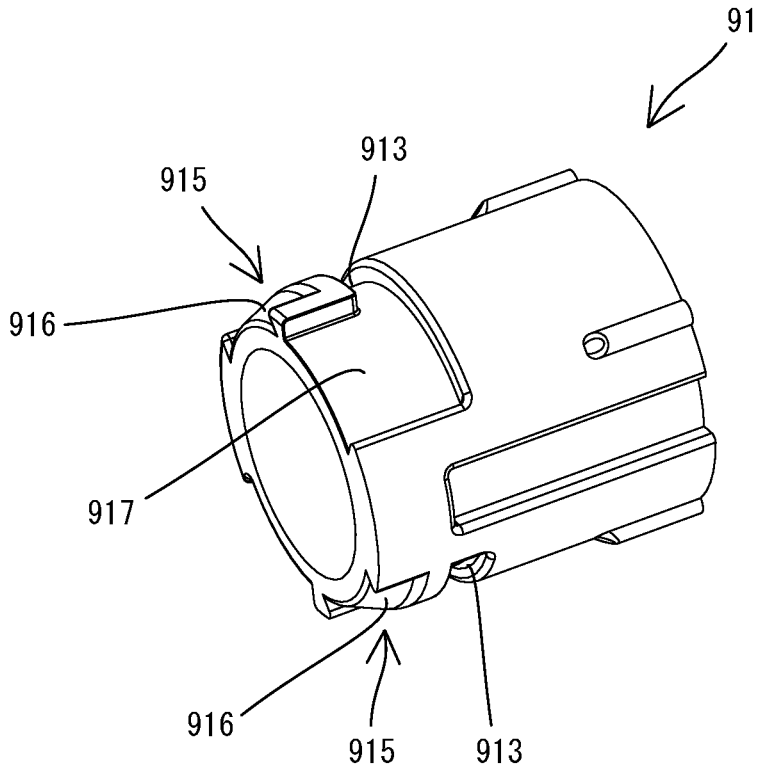
FIG. 7 is a perspective view of a lock sleeve.
Figure 14:
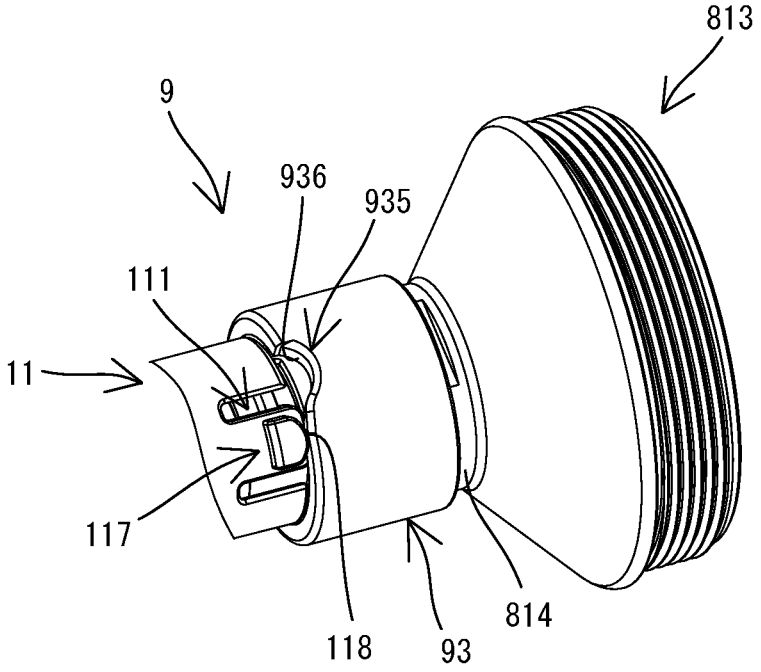
FIG. 14 is perspective view of the lock mechanism in a process of detaching the nozzle from the air duster.

As shown in FIG. 14, after the actuation projections 117 are disengaged from the receiving recess 935, the nozzle 4 is turned with the rear end surface 118 of each actuation projection 117 in abutment (contact) with the front end surface of the slide sleeve 93 while each claw 112 moves in the circumferential direction within the locking groove 913 (see FIGS. 7 and 8). When the user continues to turn the nozzle 4, the claws 112 respectively enter the release grooves 917 (see FIGS. 7 and 8). When each of the claws 112 is completely placed within the release groove 917 (the position of the nozzle 4 at this time is also referred to as a detachment position), the claw 112 is disengaged from the locking groove 913 and allowed to move forward along the release groove 917. Thus, locking of the lock mechanism 9 is released (the lock mechanism 9 is unlocked).

After turning the nozzle 4 to the detachment position, the user moves the nozzle 4 linearly forward relative to the air duster body 8 and separates (detaches, removes) the nozzle 4 from the air duster body 8. This user's manual operation (manipulation) of linearly moving the nozzle 8 forward is hereinafter also referred to as a separating operation (or detaching operation, removing operation). More specifically, the user pulls the nozzle 4 forward out of the lock mechanism 9 along the rotational axis A0. As described above, the release groove 917 has substantially the same depth as the locking groove 913. The claw 112 is therefore allowed to move forward within the release groove 917 without elastic deformation of the locking piece 111 when the nozzle 4 is moved forward in response to the separating operation. Further, the slide sleeve 93 is biased by the biasing spring 95 and moved to the front position (see FIG. 5) as the nozzle 4 is moved forward and separated from the air duster. When the nozzle 4 is separated from the air duster body 8 (the lock mechanism 9), detachment of the nozzle 4 is completed.

The air duster 1 and the nozzle 4 of the air duster 1 in the above-described first embodiment provide the following effects.

(E1) The air duster 1 includes the nozzle 4 having the discharge opening 432 on the front end (one end) in its axial direction and the vent holes 451 disposed in (at) different positions from the discharge opening 432. Therefore, the air flowing into the nozzle 4 from the air duster body 8 is discharged not only from the discharge opening 432 but also from the vent holes 451. Therefore, even in a case where surge occurs when a nozzle without the vent holes 451 is used with the air duster body 8, such surge can be suppressed (i.e., the possibility of surge can be reduced) when the nozzle 4 of this embodiment is used, owing to the vent holes 451 that allow additional discharge of the air.

(E2) With the structure of the nozzle 4, surge can be suppressed without need of changing or modifying the structure of the air duster body 8.

(E3) The flow rate of the air discharged from the discharge opening 432 of the nozzle 4 is within the surge region, if the nozzle 4 without the vent holes 451 is used with the air duster body 8. On the other hand, the total flow rate of the air discharged from the discharge opening 432 and from the vent holes 451 is outside the surge region. Thus, surge can be prevented by providing vent hole(s) to a nozzle, even if a discharge opening of the nozzle is configured to discharge air at a flow rate that falls within the surge region. For example, in some cases, it is preferred to use a nozzle having such a discharge opening. Owing to the above-described structure, the nozzle 4 of this embodiment can prevent surge. Therefore, advantageously, the structure of the air duster body 8 need not be adjusted to prevent surge.

(E4) In the structure in which the air duster body 8 has a single fan, surge can be suppressed when using a nozzle having the discharge opening 432 from which air is discharged at a flow rate within the surge region.

(E5) The vent holes 451 are between the discharge opening 432 and the air duster body 8 in the front-rear direction (the axial direction), so that the pressure of the air discharged from the vent holes 451 is lower than the pressure of the air discharged from the discharge opening 432. Therefore, compared with a structure in which a discharge opening and vent holes are arranged in the same position in the front-rear direction (the axial direction), the effects of the air discharged from the vent holes 451 on a target can be reduced.

(E6) With the structure in which the vent holes 451 are radially outward of the discharge opening 432, surge can be suppressed when using a nozzle having the discharge opening 432 from which air is discharged at a flow rate within the surge region.

(E7) The vent holes 451 are open in the same direction as the discharge opening 432 in the front-rear direction (the axial direction), so that the air discharged from the discharge opening 432 and the air discharged from the vent holes 451 flow in the same direction. Therefore, the air discharged from the discharge opening 432 and the air discharged from the vent holes 451 can be blown to a target. Thus, the air discharged from the vent holes 451 can be effectively utilized.

(E8) The vent holes 451 are closer to the air duster body 8 than the discharge opening 432 in the front-rear direction (the axial direction) and are open to the front like the discharge opening 432, and are radially outward of the discharge opening 432. Therefore, the air discharged from the vent holes 451 is entrained to the air discharged from the discharge opening 432, so that the air discharged from the nozzle 4 can be converged and blown to the target.

In relation to the above-described effect (E8), with the arrangement of the discharge opening 432 and the vent holes 451 in parallel to each other, the air discharged from the discharge opening 432 is more easily led forward than in a structure in which the discharge opening 432 and the vent holes 451 are not arranged in parallel. Therefore, the air discharged from the nozzle 4 can be more easily converged and blown the target.

(E9) The nozzle 4 is removably attachable to the air duster body 8, so that the user can selectively attach and detach various kinds of nozzles, which are different in the flow rate of air discharged from a discharge opening, to and from the air duster body 8 when using the air duster 1. In order to suppress surge of the air duster body 8, when the user wants to use a discharge opening having a flow rate within the surge region, the user may attach a nozzle having such a discharge opening and the at least one vent hole, (e.g., the nozzle 4 of this embodiment having the discharge opening 432 and the vent holes 451). On the other hand, when the user wants to use a discharge opening having a flow rate outside the surge region, the user may attach a nozzle having such a discharge opening but not having a vent hole. In this manner, in the air duster 1 of this embodiment, surge can be suppressed simply by the user selectively attaching an appropriate nozzle.

(E10) The lock mechanism 9 is configured to be actuated when the nozzle 4 is moved toward the air duster body 8 in response to a user's manipulation of attaching the nozzle 4 to the air duster body 8. The lock mechanism 9 is configured to lock the nozzle 4 in an attachment position to be immovable in a direction away from the air duster body 8 when the nozzle 4 is placed in (at) the attachment position relative to the air duster body 8. Therefore, the user only needs to move the nozzle 4 toward the air duster body 8 until the nozzle 4 is placed in (at) the attachment position relative to the air duster body 8, so that the lock mechanism 9 is actuated to lock the nozzle 4 to be immovable in the direction away from the air duster body 8. Operability (maneuverability) is therefore improved compared with a structure in which the nozzle 4 is required to be operated in two different directions.

Second Embodiment

Figure 15:
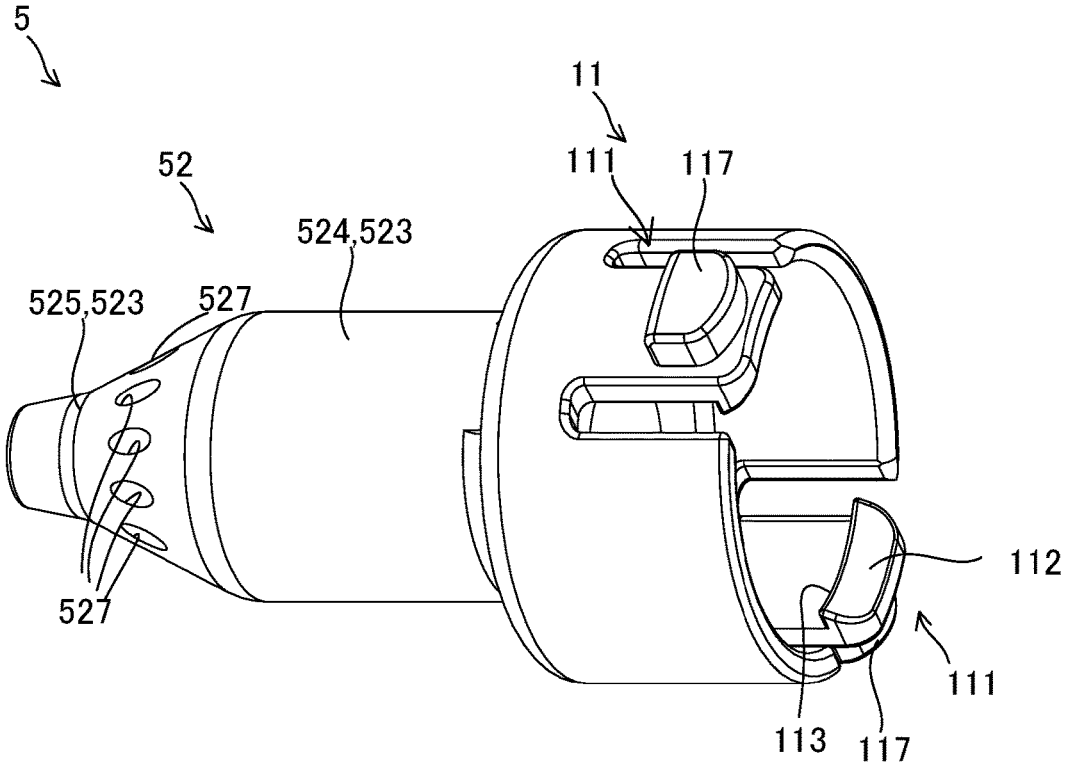
FIG. 15 is a perspective view of a nozzle according to a second embodiment.
Figure 16:
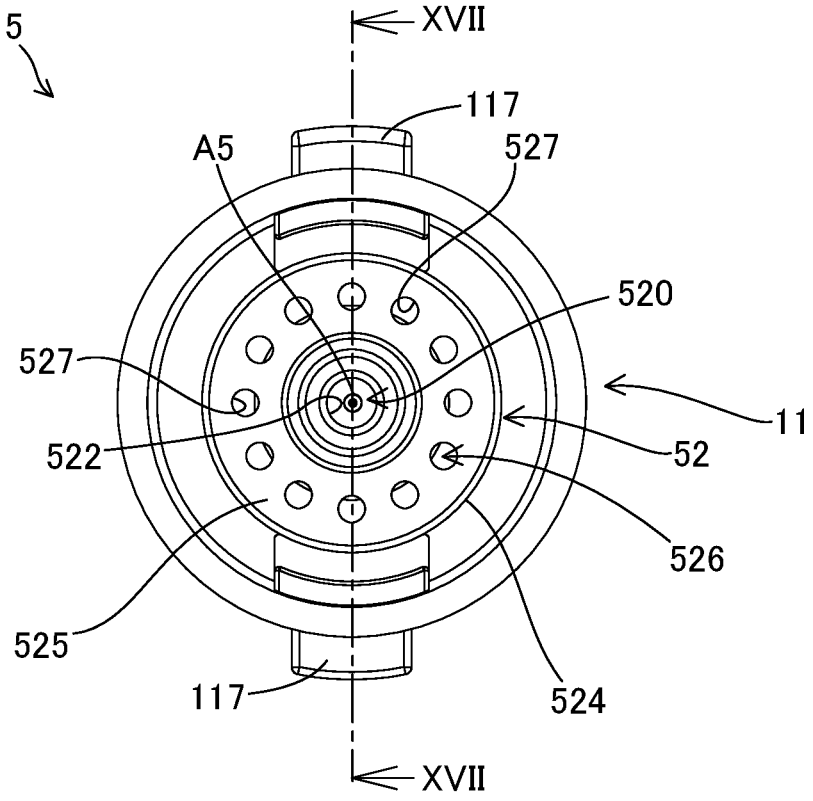
FIG. 16 is a front view of the nozzle.
Figure 17:
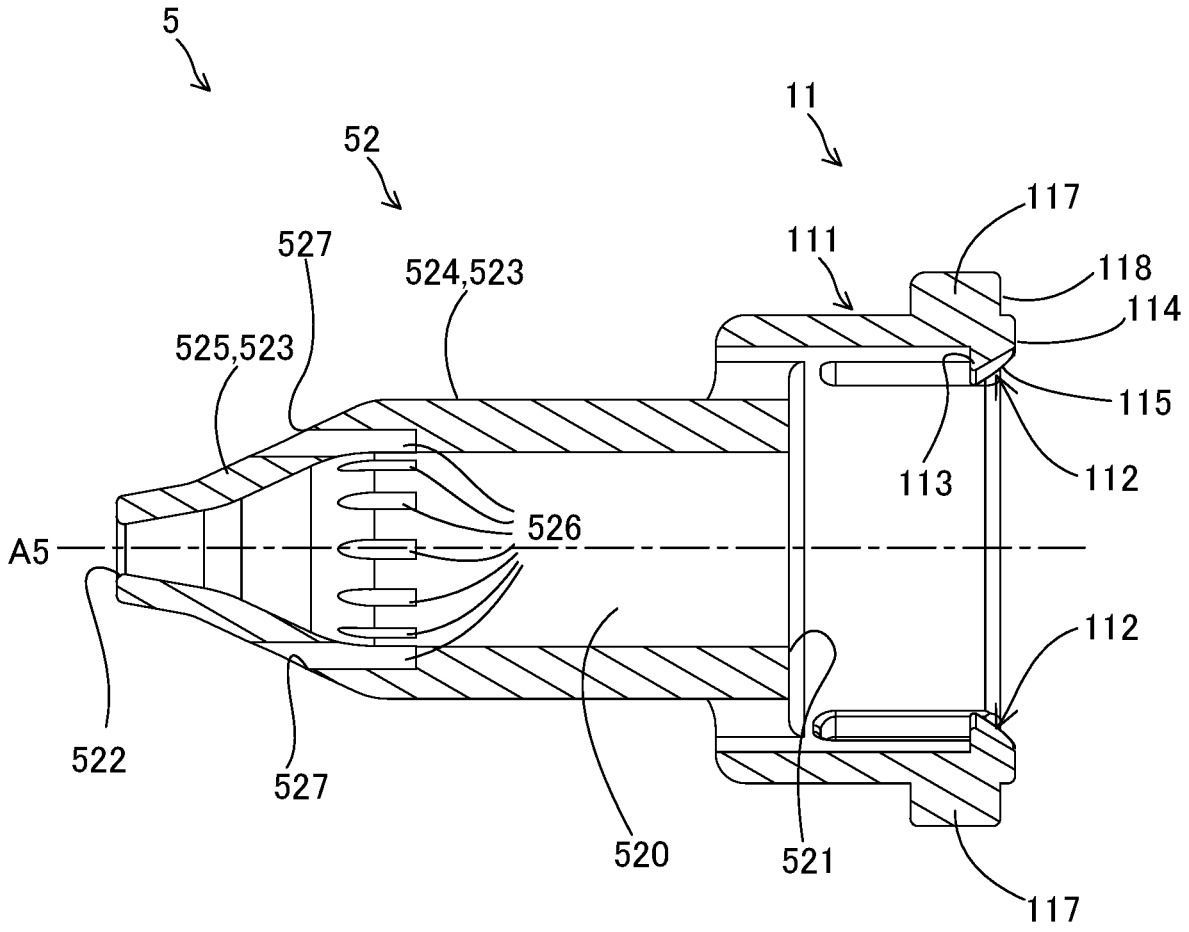
FIG. 17 is a sectional view taken along line XVII-XVII in FIG. 16.

An air duster according to the second embodiment of the present disclosure is described with reference to FIGS. 15 to 17. The air duster includes the air duster body 8 and a nozzle 5. The air duster body 8 has the same structure as that of the first embodiment and is not therefore described and shown. The nozzle 5 is another example of the nozzles that can be attached to the air duster body 8. The nozzle 5 of this embodiment partially has substantially the same structure as the nozzle 4 of the first embodiment. Therefore, components of the nozzle 5 which are substantially identical to those of the nozzle 4 are given the same numerals as in first embodiment and are not described or briefly described, and a different structure is mainly described. The same applies to the following embodiments.

The nozzle 5 of this embodiment includes the mounting part 11 configured to be attached to the nozzle part 82 (specifically, the lock mechanism 9) of the air duster body 8, and a body part 52 connected to the mounting part 11. The mounting part 11 and the body part 52 are integrally formed of synthetic resin (polymer).

The body part 52 protrudes forward along an axis A5 of the nozzle 5 from a front end of the mounting part 11. The body part 52 includes a cylindrical wall 523. A large portion of the cylindrical wall (tubular wall) 523, including its rear end portion, forms a hollow circular cylindrical portion. This portion of the cylindrical wall 523 is hereinafter also referred to as a circular cylindrical part 524. A front end portion of the cylindrical wall 523 forms a hollow, generally conical cylindrical portion having an outer diameter gradually decreasing toward the front. This portion of the cylindrical wall 523 is hereinafter also referred to as a conical cylindrical part 525. The cylindrical wall 523 defines a passage 520 extending in the front-rear direction along the axis A5. Although not shown in detail, when the nozzle 5 is attached to the air duster body 8, air blown out by the centrifugal fan 885 of the air duster body 8 flows into the nozzle 5 through a rear end opening of the cylindrical wall 523 (a rear end inlet opening of the passage 520), flows through the passage 520 and is discharged from a front end opening of the cylindrical wall 523 (a front end outlet opening of the passage 520). The rear end opening and the front end opening of the cylindrical wall 523 are hereinafter referred to as an inlet opening 521 and a discharge opening 522, respectively. The discharge opening 522 has a diameter of 3.0 mm.

A plurality of openings are formed in the conical cylindrical part 525 of the cylindrical wall 523 extending rearward of the discharge opening 522. Each of the openings has an elliptical shape having a minor axis in the circumferential direction. The openings are formed substantially in the same position in the axial direction of the nozzle 5 and arranged substantially at equal intervals in the circumferential direction. These openings are also referred to as vent holes (vent openings) 527.

A plurality of vent passages 526 are formed in the cylindrical wall 523. The vent passages 526 extend through the cylindrical wall 523 in the front-rear direction. More specifically, the vent passages 526 extend from a front end of the circular cylindrical part 524 of the cylindrical wall 523 to the conical cylindrical part 525 rearward of the discharge opening 522. The vent passages 526 are connected to the vent holes 527, respectively. The vent holes 527 can also be regarded as outlet openings of the respective vent passages 526 that extend through a side portion of the conical cylindrical part 525 in the front-rear direction.

Thus, in the nozzle 5, the vent holes 527 are formed in the conical cylindrical part 525 and open obliquely with respect to the axis A5 of the nozzle 5.

With such a structure, the air blown out of the air duster body 8 by the centrifugal fan 885 flows through the passage 520 and the vent passages 526, and is discharged not only from the discharge opening 522, but also from the vent holes 527.

In this embodiment, like in the first embodiment, the vent holes 527 are configured to have a function of preventing surge. Specifically, the flow rate of the air discharged from the discharge opening 522 of the nozzle 5 is within the surge region when a nozzle not having a vent hole and having a discharge opening having the same area as the discharge opening 522 of the nozzle 5 is used with the air duster body 8. The vent holes 527 are configured such that the total flow rate of the air discharged from the discharge opening 522 and from the vent holes 527 of the nozzle 5 is outside the surge region.

Thus, the nozzle 5 of this embodiment does not cause surge when the air duster 1 is operated with the nozzle 5 connected to the air duster body 8. Further, if the vent holes 527 are closed and air is not discharged from the vent holes 527, the nozzle 4 causes surge.

According to this embodiment, the vent holes 527 are formed in the conical cylindrical part 525 and open (extend) obliquely relative to the axis A5 of the nozzle 5, so that the air is discharged forward and radially outward from the vent holes 527. Therefore, the air discharged from the vent holes 527 partly flows in the same direction as the air discharged from the discharge opening 522, so that the air discharged from the discharge opening 522 and the air discharged from the vent holes 527 can be blown to a target. Thus, the air discharged from the vent holes 527 can be effectively utilized. Further, the vent holes 527 are closer to the air duster body 8 than the discharge opening 522 in the front-rear direction (the axial direction). Therefore, the air discharged from the vent holes 527 is partly entrained to the air discharged from the discharge opening 522, so that the air discharged from the nozzle 5 can be converged and blown to the target.

According to this embodiment, compared with a structure in which a discharge opening and vent holes are arranged in parallel, the effects of the air discharged from the vent holes 527 on the target can be reduced. Further, the nozzle 5 has substantially the same structure as the nozzle 4 of the first embodiment except for the above-described points. Thus, the nozzle 5 of this embodiment also has the same effects as the above-described effects (E1) to (E6), (E9) and (E10) of the first embodiment.

Third Embodiment

A nozzle 6 of the air duster according to the third embodiment of the present disclosure is described with reference to FIGS. 18 to 20. The nozzle 6 is another example of the nozzles that can be attached to the air duster body 8.

Figure 18:
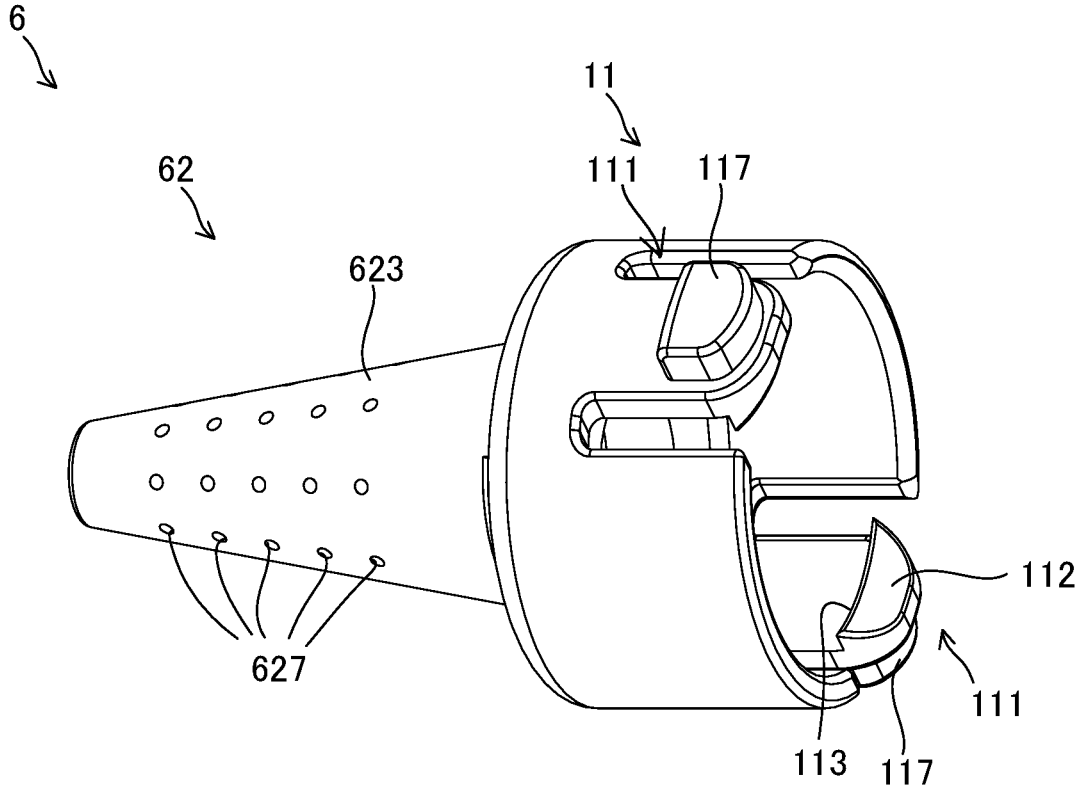
FIG. 18 is a perspective view of a nozzle according to a third embodiment.
Figure 19:
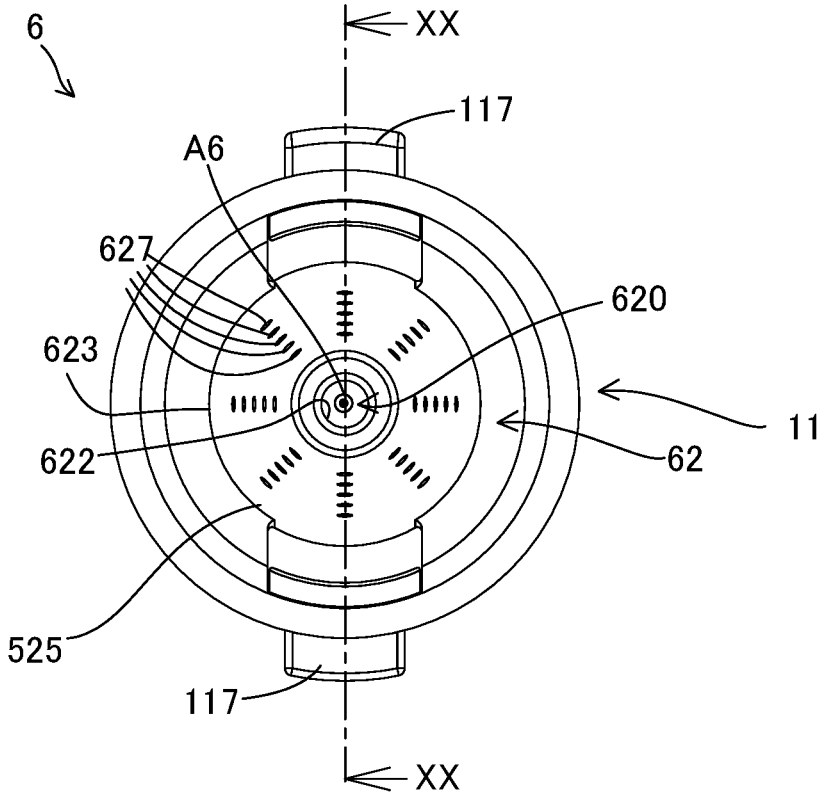
FIG. 19 is a front view of the nozzle.
Figure 20:
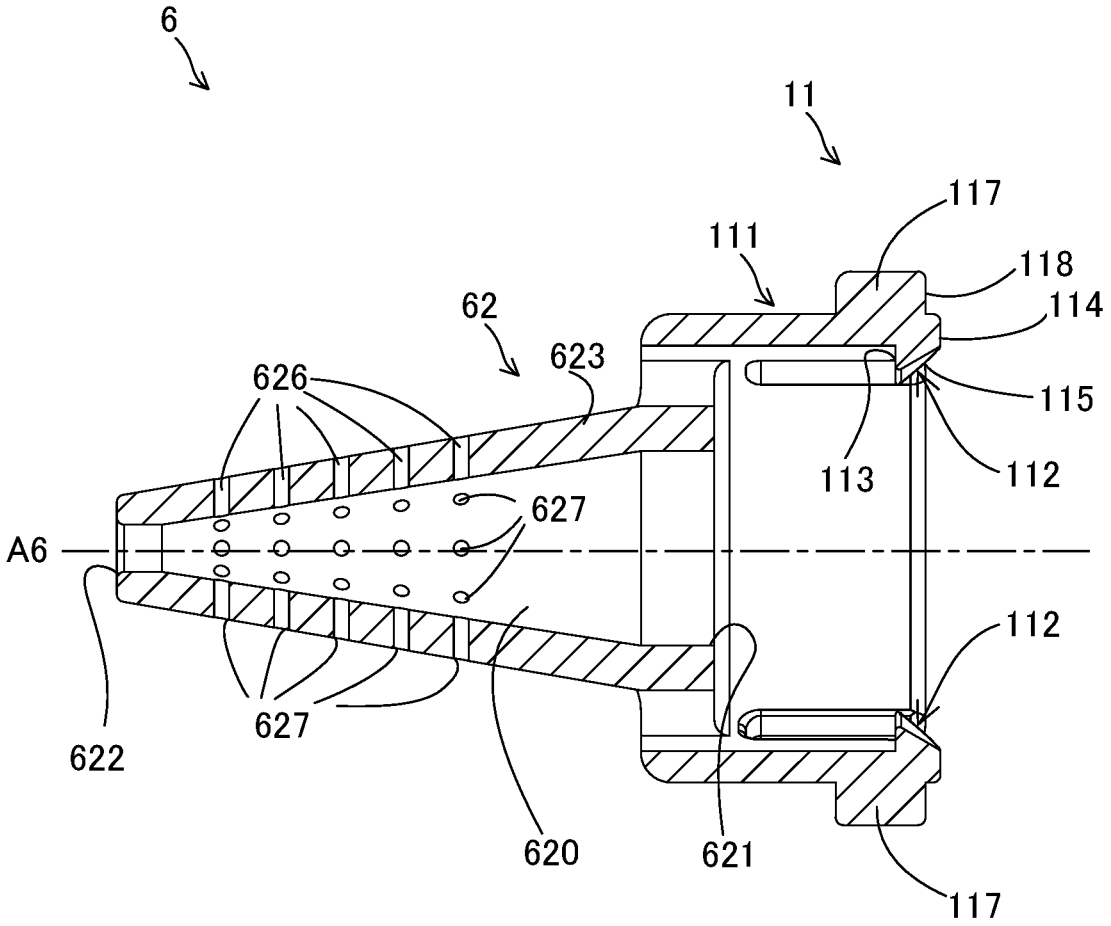
FIG. 20 is a sectional view taken along line XX-XX in FIG. 19.

As shown in FIGS. 18 to 20, the nozzle 6 includes the mounting part 11 configured to be attached to the nozzle part 82 (specifically, the lock mechanism 9) of the air duster body 8, and a body part 62 connected to the mounting part 11. The mounting part 11 and the body part 62 are integrally formed of synthetic resin (polymer).

The body part 62 protrudes forward along an axis A6 of the nozzle 6 from a front end of the mounting part 11. The body part 62 includes a cylindrical wall (tubular wall) 623 having a hollow, generally conical shape. The cylindrical wall 623 has outer and inner diameters gradually decreasing toward the front. The cylindrical wall 623 defines a passage 620 extending in the front-rear direction along the axis A6. Although not shown in detail, when the nozzle 6 is attached to the air duster body 8, air blown out by the centrifugal fan 885 of the air duster body 8 flows into the nozzle 6 through a rear end opening of the cylindrical wall 623 (a rear end inlet opening of the passage 620), flows through the passage 620 and is discharged from a front end opening of the cylindrical wall 623 (a front end outlet opening of the passage 620). The rear end opening and the front end opening of the cylindrical wall 623 are hereinafter referred to as an inlet opening 621 and a discharge opening 622, respectively. The discharge opening 622 has a diameter of 3.0 mm. The cylindrical wall 623 of the nozzle 6 can also be regarded as a side portion of a hollow conical cylinder having an outer diameter gradually decreasing toward the discharge opening 622.

A plurality of openings are formed in the cylindrical wall 623, between the discharge opening 622 and the inlet openings 621 in the front-rear direction. Each of the openings has a generally circular shape and faces radially outward. The openings are arranged substantially at equal intervals in the axial direction and in the circumferential direction. As shown in FIG. 19, the openings are arranged radially around the discharge opening 622 when the nozzle 6 is viewed from the front. These openings are also referred to as vent holes (vent openings) 627.

A plurality of vent passages 626 are formed in the cylindrical wall 623 and extend radially through the cylindrical wall 623. The vent passages 626 are connected to the vent holes 627, respectively. The vent holes 627 can also be regarded as outlet openings of the vent passages 626 that extend through the side portion of the hollow conical cylinder in the radial direction.

With such a structure, the air blown out of the air duster body 8 by the centrifugal fan 885 flows through the passage 620 and the vent passages 626, and is discharged not only from the discharge opening 622, but also from the vent holes 627.

In this embodiment, like in the above-described embodiments, the vent holes 627 are configured to have a function of preventing surge. Specifically, the flow rate of the air discharged from the discharge opening 622 of the nozzle 6 is within the surge region when a nozzle not having a vent hole and having a discharge opening having the same area as the discharge opening 522 of the nozzle 5 is used with the air duster body 8. The vent holes 627 are configured such that the total flow rate of the air discharged from the discharge opening 622 and from the vent holes 627 of the nozzle 6 is outside the surge region.

Thus, the nozzle 6 of this embodiment does not cause surge when the air duster 1 is operated with the nozzle 6 connected to the air duster body 8. Further, if the vent holes 627 are closed and air is not discharged from the vent holes 627, the nozzle 6 causes surge.

According to this embodiment, the vent passages 626 radially extend through the cylindrical wall 623, and the vent holes 627 open radially outward, so that the air is mainly discharged radially outward from the vent holes 627. Therefore, compared with a structure in which vent holes face in the same direction as a discharge opening, the effects of the air discharged from the vent holes 627 on a target can be reduced. Further, the nozzle 6 has substantially the same structure as the nozzle 4 of the first embodiment except for the above-described points. Thus, the nozzle 6 of this embodiment also has the same effects as the above-described effects (E1) to (E6), (E9) and (E10) of the first embodiment.

Fourth Embodiment

A nozzle 2 according to the fourth embodiment of the present disclosure is described with reference to FIGS. 21 to 25. The nozzle 2 is another example of the nozzles that can be attached to the air duster body 8.

Figure 21:
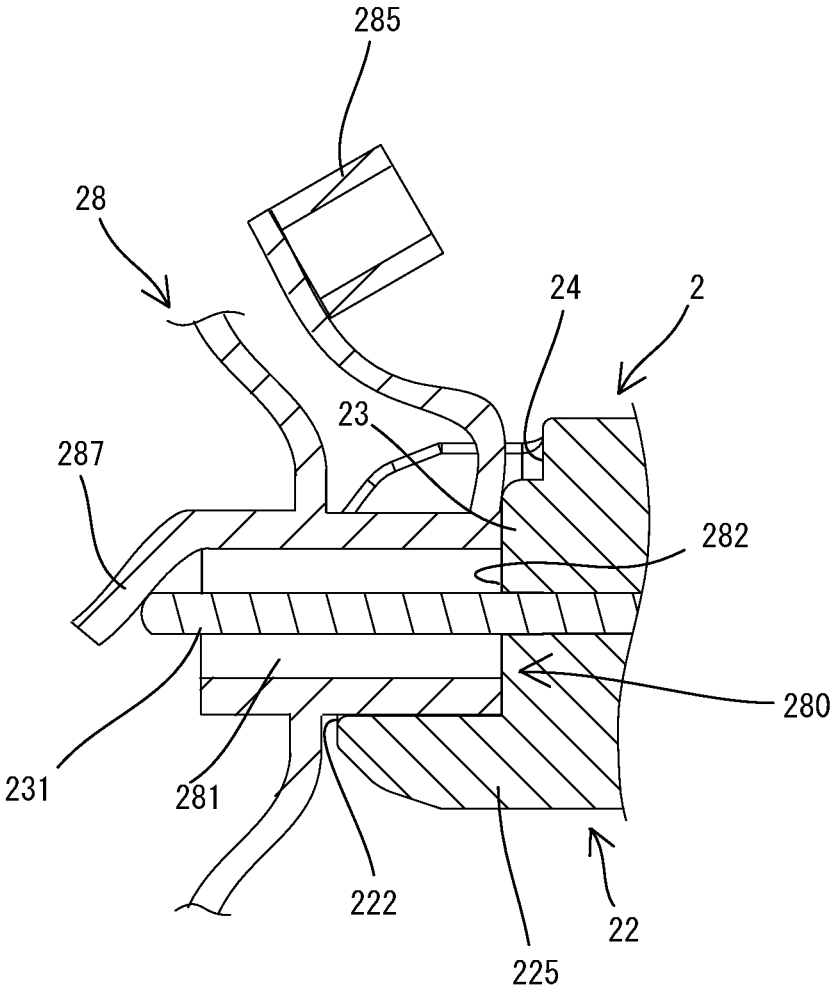
FIG. 21 shows an example of a projection for air injection.
Figure 22:
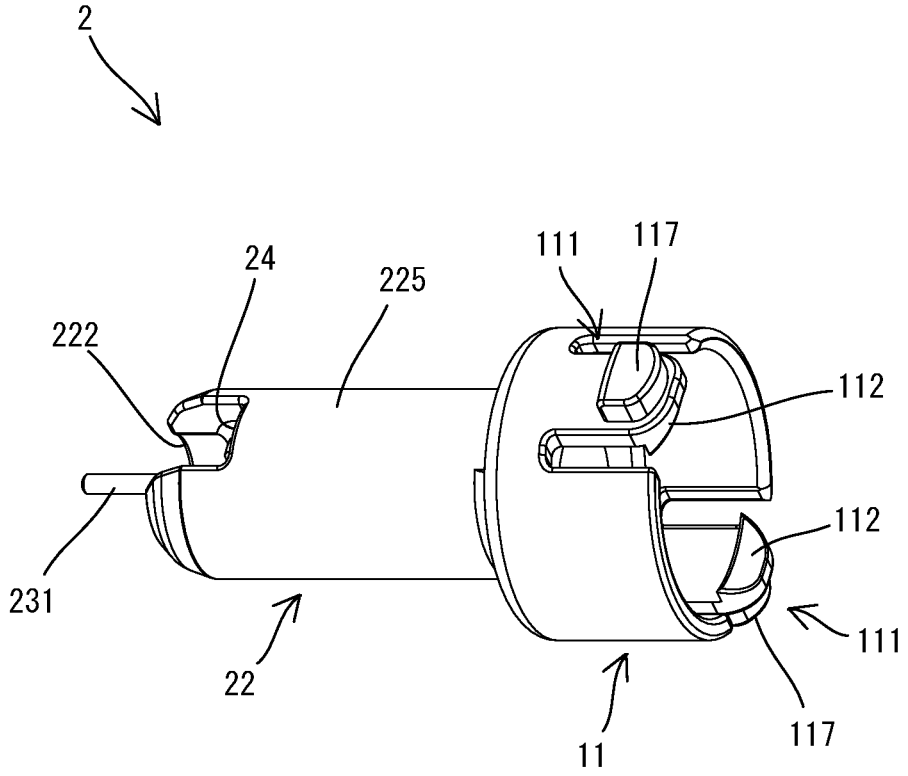
FIG. 22 is a perspective view of a nozzle according to a fourth embodiment.
Figure 23:
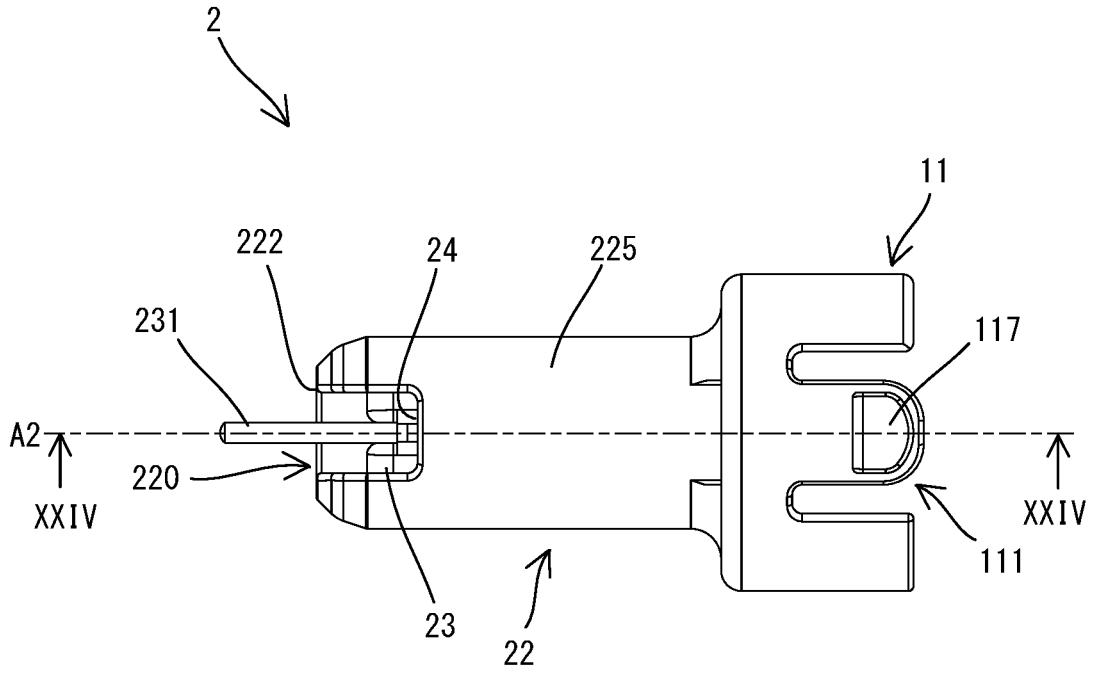
FIG. 23 is a side view of the nozzle.
Figure 24:
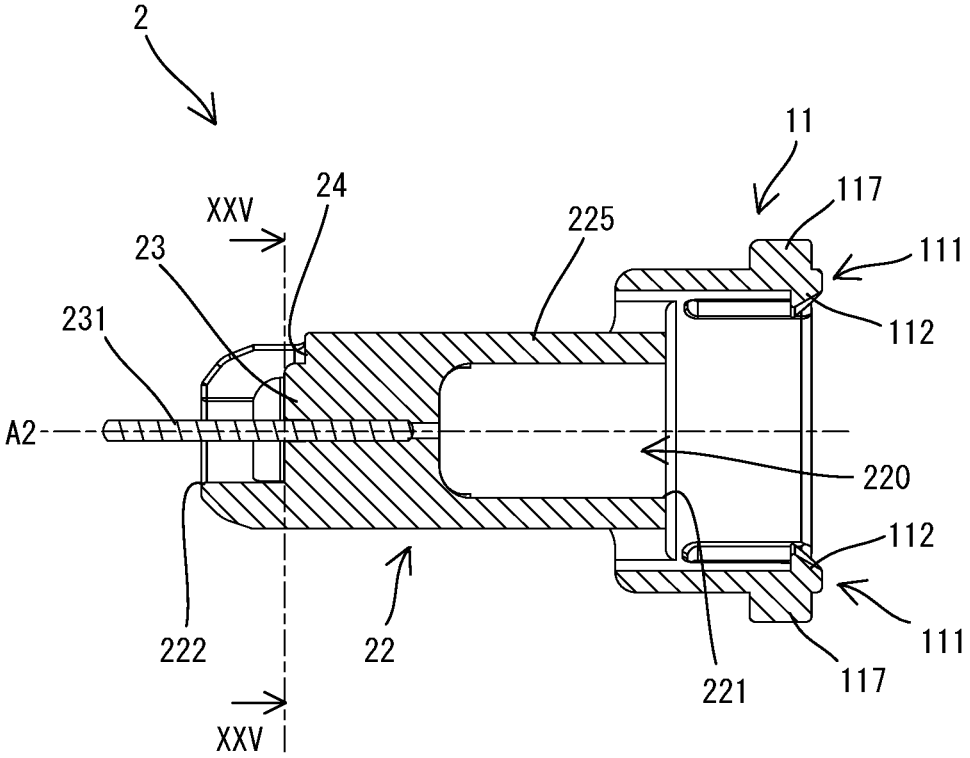
FIG. 24 is a sectional view taken along line XXIV-XXIV in FIG. 23.
Figure 25:
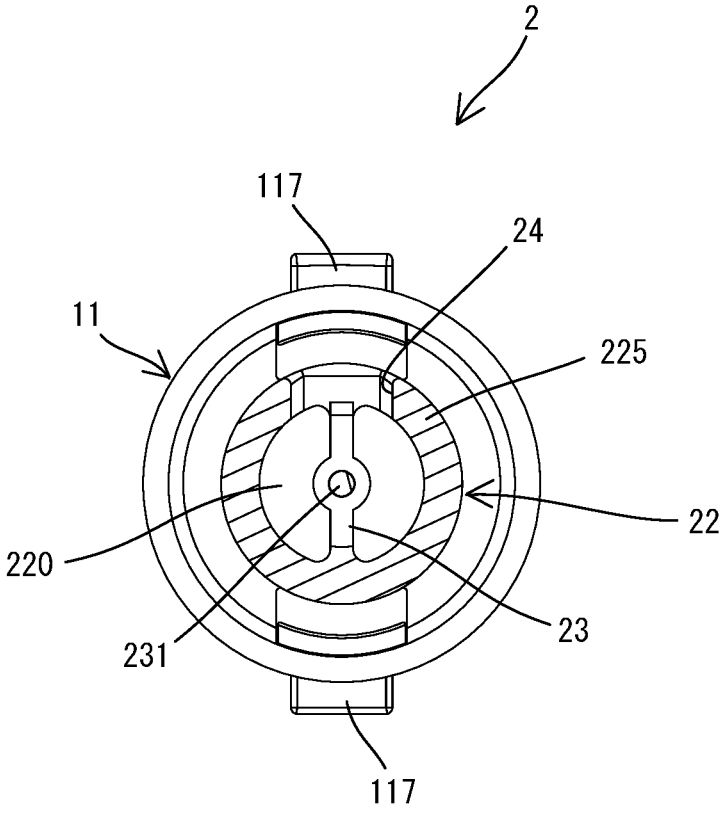
FIG. 25 is a sectional view taken along line XXV-XXV in FIG. 24.

The nozzle 2 of this embodiment has a structure that is suitable for injecting air into an air injection projection (also called an air injection valve or an air plug) formed on an inflatable object. The inflatable object refers, for example, to an article (such as a float, a beach ball and an air mattress) to be inflated with air for use. FIG. 21 shows an example of a general air injection projection 280 having a known structure. As shown in FIG. 21, the projection 280 is formed as a hollow cylinder and defines a passage 281 for providing communication between the inside and outside of a bag-shaped object 28. The projection 280 has an outer diameter of about 9.5 mm and an inner diameter of about 6.5 mm.

The projection 280 protrudes outward from an outer surface of the object 28. A plug 285 for closing an opening (hereinafter referred to as an inlet opening 282) of the passage 281 is connected to an end (protruding end) of the projection 280 outside the object 28. Further, a valve 287 is connected to the other end of the projection 280 inside the object 28. The valve 287 is configured to close an inside opening (hereinafter referred to as an outlet opening 283) of the passage 281 by the air pressure inside the object 28. The projection 280, the plug 285 and the valve 287 are integrally formed of flexible synthetic resin (polymer), such as PVC.

As shown in FIGS. 22 to 25, the nozzle 2 includes the mounting part 11 configured to be attached to the nozzle part 82 (specifically, the lock mechanism 9) of the air duster body 8, and a body part 22 connected to the mounting part 11. The mounting part 11 and the body part 22 are integrally formed of synthetic resin (polymer).

The body part 22 protrudes forward along an axis A2 of the nozzle 2 from a front end of the mounting part 11. The body part 22 includes a cylindrical wall (tubular wall) 225. The cylindrical wall 225 defines a passage 220 extending in the front-rear direction along the axis A2. Although not shown in detail, when the nozzle 2 is attached to the air duster body 8, air blown out by the centrifugal fan 885 of the air duster body 8 flows into the nozzle 2 from a rear end opening of the cylindrical wall 225 (a rear end inlet opening of the passage 220), flows through the passage 220, and is discharged from a front end opening of the cylindrical wall 225 (a front end outlet opening of the passage 220). The rear end opening and the front end opening of the cylindrical wall 225 are hereinafter referred to as an inlet opening 221 and a discharge opening 222, respectively. A front end portion of the passage 220 and the discharge opening 222 have a diameter of 10.0 mm.

Further, a stopper 23 is provided within the cylindrical wall 225. The stopper 23 is configured to define the position of the protruding end of the projection 280 (i.e. an amount of insertion of the projection 280) when the projection 280 is inserted into the cylindrical wall 225. More specifically, the stopper 23 is a wall portion that contains the axis A2 and is connected to an inner peripheral surface of the cylindrical wall 225 across the passage 220. A front end of the stopper 23 is located rearward of a front end of the cylindrical wall 225. Thus, as shown in FIG. 21, the projection 280 can be inserted into the passage 220 through the discharge opening 222 up to a position where the protruding end of the projection 280 abuts on (contacts) the stopper 23. A pin 231 is fixed to the stopper 23. The pin 231 protrudes forward of the discharge opening 222, so that the pin 231 abuts on (contacts) the valve 287 of the projection 280 and open the valve 287 when the projection 280 is inserted into the passage 220. The pin 231 may however be omitted.

As shown in FIGS. 22 to 25, a vent hole (vent opening) 24 is formed in the cylindrical wall 225. The vent hole 24 is an opening that extends through the cylindrical wall 225 to provide communication between the inside (the passage 220) and outside of the cylindrical wall 225. The vent hole 24 extends from a position rearward of (from a position closer to the mounting part 11 than) the front end of the stopper 23 to the front end of the cylindrical wall 225 in the axial direction of the cylindrical wall 225, such that the vent hole 24 communicates (is connected, is continuous) with the discharge opening 222. In other words, the vent hole 24 is an opening that extends rearward from the front end of the cylindrical wall 225 to a position rearward of the front end of the stopper 23.

With such a structure, when the projection 280 is inserted into the passage 220 through the discharge opening 222, a side surface of the projection 280 closes a portion of the vent hole 24, which portion extends from the front end of the cylindrical wall 225 to a position corresponding to the front end of the stopper 23. At this time, the passage 220 communicates with the outside of the cylindrical wall 225 through a remaining portion of the vent hole 24, which portion extends rearward of the position corresponding to the front end of the stopper 23.

In this embodiment, the air is supplied into the object 28 with the projection 280 fitted into the front end portion of the passage 220. The diameter of the passage 220 and the discharge opening 222 of the nozzle 2 is 10.0 mm, while the inner diameter of the projection 280 (the diameter of the discharge opening 283 of the passage 281) is 6.5 mm, which is smaller than 10.0 mm. Further, it is known that, when the air duster body 8 is operated with a piping that has a discharge opening having a diameter of 6.5 mm, the flow rate of air is within the surge region. Therefore, if the nozzle 2 is attached to the air duster body 8 and the air is blown out only into the projection 280, surge may occur.

Accordingly, in this embodiment, like in the above-described embodiments, the vent hole 24 is configured to have a function of preventing surge. The vent hole 24 is configured to increase the total flow rate of the air discharged from the discharge opening 283 of the passage 281 of the projection 280 and the air discharged from the vent hole 24, such that the total flow rate is outside the surge region, thereby preventing surge. Specifically, the above-described total flow rate of the air is set to be outside the surge region by properly setting the area of the portion of the vent hole 24 that is not closed by the projection 280 (that is, the portion extending rearward of the stopper 23). In this embodiment, the flow rate of the air discharged from the discharge opening 283 via the discharge opening 222 is within the surge region when a different nozzle not having a vent hole and having a discharge opening having the same area as the discharge opening 222 is used with the air duster body 8 and with the projection 280 inserted into of the different nozzle through the discharge opening. Further, the vent hole 24 of the nozzle 2 is configured such that the total flow rate of the air discharged from the discharge opening 283 via the discharge opening 222 and the air discharged from the portion of the vent hole 24 that is not closed by the projection 280 is outside the surge region.

Thus, the nozzle 2 of this embodiment does not cause surge when the air duster 1 is operated with the nozzle 2 connected to the air duster body 8 and with the projection 280 inserted into the passage 220 from the discharge opening 222. Further, in the nozzle 2 of this embodiment, if the vent hole 24 is completely closed with the nozzle 2 connected to the air duster body 8 and with the projection 280 inserted into the passage 220 through the discharge opening 222, the nozzle 2 causes surge.

According to this embodiment, surge can be prevented when the nozzle 2 is used with the air duster body 8 and with the projection 280 inserted into the passage 220 through the discharge opening 222. Thus, surge can be prevented when the air is injected into the air injection projection (air injection valve, air plug) provided on an inflatable object. The nozzle 2 has substantially the same structure as the nozzle 4 of the first embodiment except for the above-described points. Thus, the nozzle 2 of this embodiment also has the same effects as the above-described effects (E1) to (E5), (E9) and (E10) of the first embodiment.

Fifth Embodiment

A nozzle 3 according to the fifth embodiment of the present disclosure is described with reference to FIGS. 26 to 35. The nozzle 3 is another example of the nozzles that can be attached to the air duster body 8.

Figure 26:
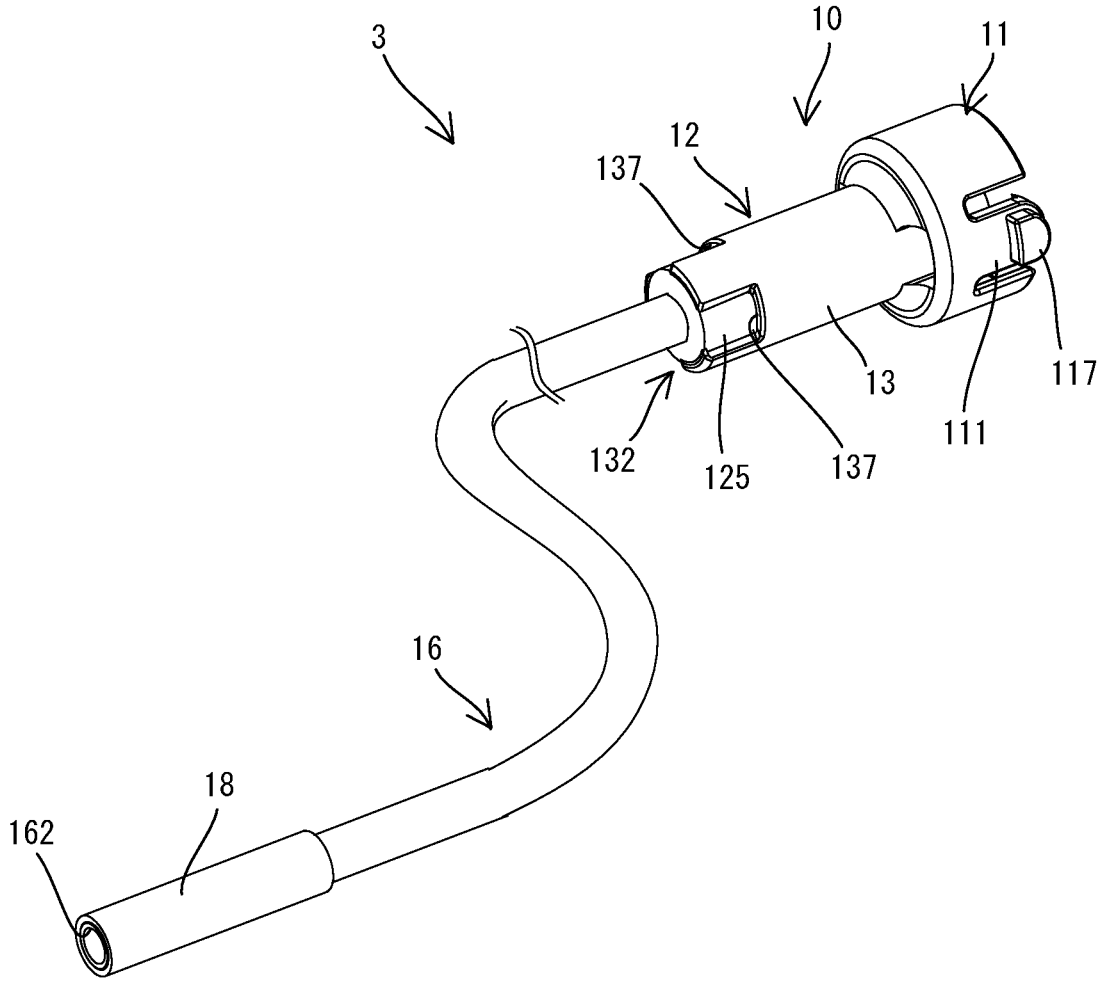
FIG. 26 is a perspective view of a nozzle according to a fifth embodiment.

As shown in FIG. 26, the nozzle 3 has a base member 10 configured to be attached to the air duster body 8, and a flexible tube 16 connected to the base member 10. The nozzle 3 of this embodiment is configured such that the flexible tube 16 has a discharge opening 162 and a user can relatively freely change the position of the discharge opening 162 relative to the air duster body 8, depending on a desired position to blow compressed air.

Figure 27:
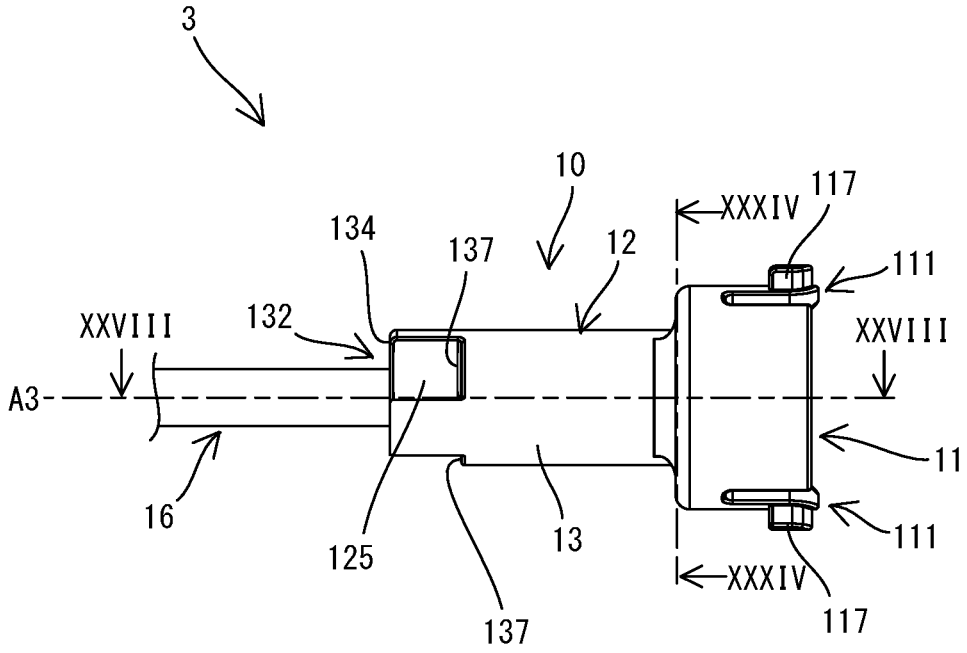
FIG. 27 is a side view of the nozzle.
Figure 28:
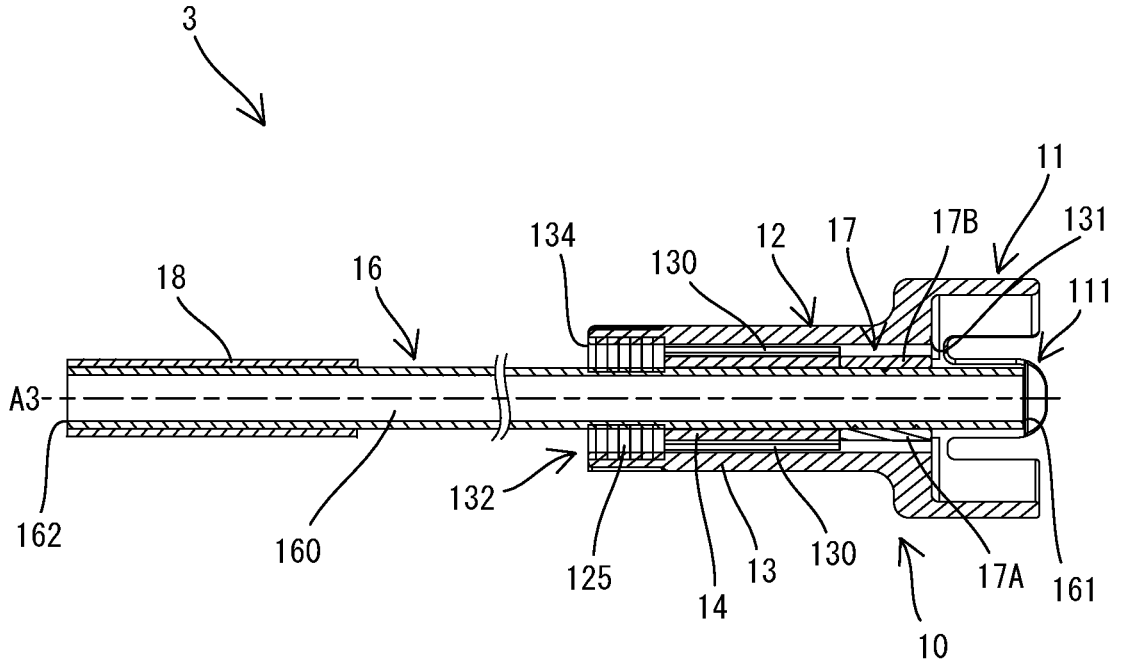
FIG. 28 is a sectional view taken along line XXVIII-XXVIII in FIG. 27.
Figure 29:
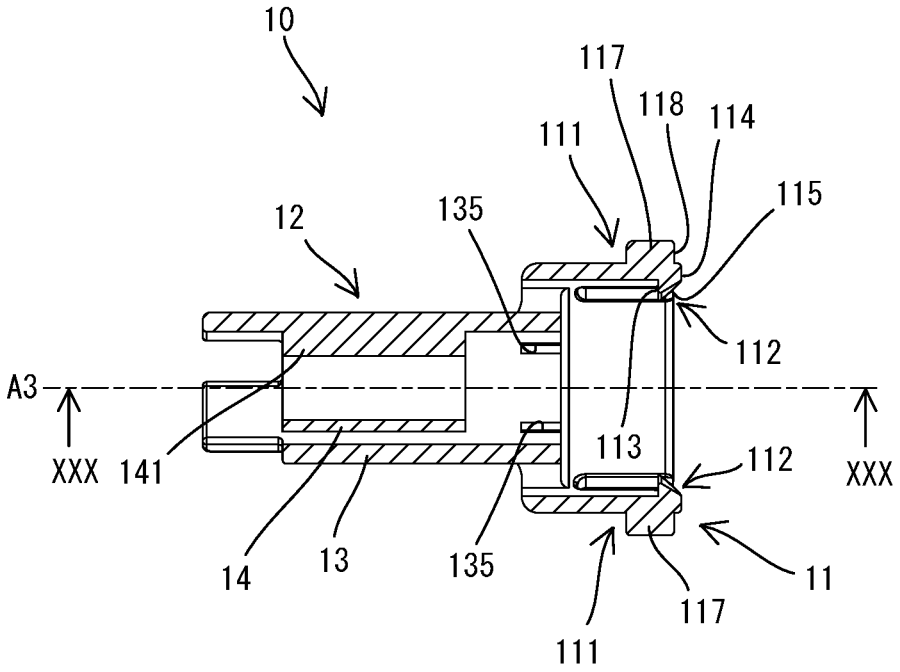
FIG. 29 is a sectional view of a base member.
Figure 30:
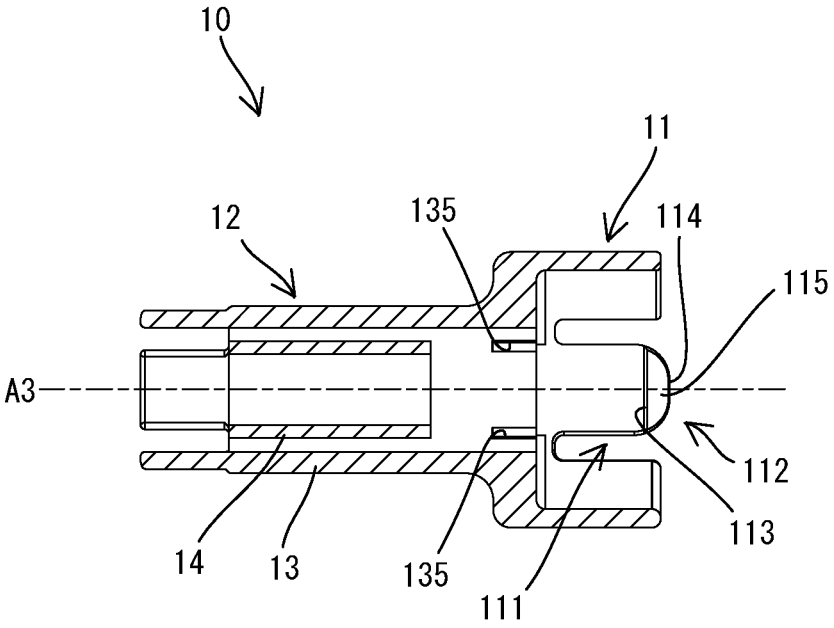
FIG. 30 is a sectional view taken along line XXX-XXX in FIG. 29.
Figure 31:
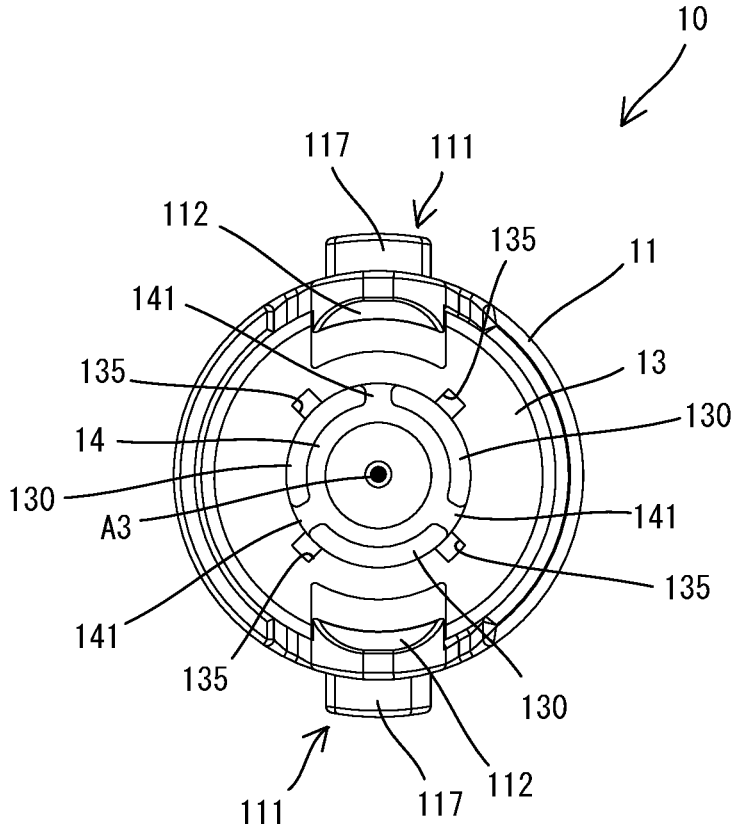
FIG. 31 is a back view of the base member.

A base member 10 is first described. As shown in FIGS. 26 to 28, the base member 10 is an elongate tubular member (hollow cylindrical member) that extends along an axis A3. The base member 10 includes the mounting part 11 and a holding part 12. In this embodiment, the mounting part 11 and the holding part 12 are integrally formed of synthetic resin (polymer). However, the mounting part 11 and the holding part 12 may be separately formed from each other and connected together. The mounting part 11 is configured to be attached to the nozzle part 82 (specifically, the lock mechanism 9) of the air duster body 8. The holding part 12 protrudes from an axial end of the mounting part 11 in its axial direction. The holding part 12 engages with and holds the flexible tube 16. The holding part 12 forms a body part of the nozzle 3 together with the flexible tube 16.

As shown in FIGS. 28 to 31, the holding part 12 is a double-walled tube (hollow cylinder). Specifically, the holding part 12 includes an outer tube (outer cylinder) 13 and an inner tube (inner cylinder) 14 that are coaxially arranged with each other.

The outer tube 13 is a hollow cylindrical portion that extends forward from the mounting part 11. The outer tube 13 has a stepped hollow cylindrical shape having a rear end portion having an outer diameter larger than the other portion of the outer tube 13. The outer tube 13 has a uniform inner diameter slightly larger than the diameter of the discharge opening 820 of the air duster body 8. Four recesses 135 are formed at equal intervals in the circumferential direction in an inner peripheral surface of the rear end portion of the outer tube 13. Each of the recesses 135 has an open rear end. Further, three rectangular openings 137 (see FIGS. 26 and 27) are formed at equal intervals in the circumferential direction in a front end portion of the outer tube 13. The openings 137 are formed through the outer tube 13 (i.e. a cylindrical wall, tubular wall) to provide communication between the inside and outside of the outer tube 13, and extend to a front end of the outer tube 13.

The inner tube 14 is a hollow cylindrical portion having substantially the same inner diameter as the outer diameter of the flexible tube 16. The inner tube 14 is within (radially inward of) the outer tube 13 such that there is a space between the inner tube 14 and the outer tube 13. More specifically, the inner tube 14 is connected to the outer tube 13 and supported by three ribs 141. The ribs 141 are spaced apart from each other in the circumferential direction around the axis A3. Thus, the three ribs 141 partition the space between the outer tube 13 and the inner tube 14 of the holding part 12 in the circumferential direction, into three spaces each extending in the front-rear direction. A rear end of the inner tube 14 is located forward of a rear end of the outer tube 13 (more specifically, forward of the recesses 135) in the front-rear direction, and a front end of the inner tube 14 is located rearward of a front end of the outer tube 13. A rear end of each of the openings 137 of the outer tube 13 is located in (at) the same position in the front-rear direction as the front end of the inner tube 14.

The flexible tube 16 is now described. As shown in FIGS. 26 and 28, the flexible tube 16 is a tubular member (a tube or a pipe) that is flexible and made of synthetic resin (polymer). In this embodiment, the flexible tube 16 is formed of polyvinyl chloride (PVC) and has superior flexibility. The flexible tube 16 is a tubular member having a circular section, and has uniform outer and inner diameters when no external force is applied thereto. In this embodiment, the flexible tube 16 has an inner diameter of 6 mm and has a length of 70 cm.

One end portion of the flexible tube 16 is connected to the holding part 12. One end of the flexible tube 16 that is connected to the holding part 12 is hereinafter referred to as a base end, and the other end as a leading end. In this embodiment, when the nozzle 3 is attached to the air duster body 8, air blown out by the centrifugal fan 885 of the air duster body 8 flows into the nozzle 3 through an opening of the flexible tube 16 at the base end, flows through a passage 160 extending through the flexible tube 16, and is discharged from an opening of the flexible tube 16 at the leading end. The opening of the flexible tube 16 at the base end (a rear end inlet opening of the passage 160) is hereinafter referred to as an inlet opening 161, and the opening at the leading end (a front end outlet opening of the passage 160) is as a discharge opening 162.

A cover 18 is mounted onto a portion of the flexible tube 16 including the leading end portion. The cover 18 is formed of synthetic resin (polymer) having substantially no flexibility (or having significantly lower flexibility than the flexible tube 16). The cover 18 is a hollow cylindrical member having an inner diameter that is substantially equal to the outer diameter of the flexible tube 16, and is fitted around the flexible tube 16. An inner peripheral surface of the cover 18 is subjected to non-slip processing to suppress slippage of the flexible tube 16. The user can however pull and remove the cover 18 from the flexible tube 16 or moves the cover 18 to a different position relative to the flexible tube 16, as necessary.

A structure of connecting the flexible tube 16 and the holding part 12 is now described.

As shown in FIGS. 28 and 32 to 35, the flexible tube 16 is inserted through the inner tube 14. A base end portion of the flexible tube 16 protrudes rearward of the rear end of the outer tube 13. An engagement member 17 is fitted around the base end portion of the flexible tube 16. The engagement member 17 as a whole is a hollow cylindrical member having an inner diameter slightly smaller than the outer diameter of the flexible tube 16. In this embodiment, the engagement member 17 includes a first member 17A and a second member 17B. The first and second members 17A and 17B are each semi-cylindrical. The first and second members 17A and 17B are put together such that they abut on (contact) each other along a plane that contains an axis of the engagement member 17. The first and second members 17A and 17B have mostly the same structure. In the following description, the structure common to the first and second members 17A and 17B are given the same numerals.

Two ridges 171A are respectively formed on both axial end portions of an inner peripheral surface of the first member 17A. Each of the ridges 171A extends in the circumferential direction and has a generally triangular section. One ridge 171B is formed on a central portion of an inner peripheral surface of the second member 17B in the front-rear direction. The ridge 171B extends in the circumferential direction and has a generally triangular section. When the flexible tube 16 is placed between the first and second members 17A and 17B and the first and second members 17A and 17B are put together to abut on each other, the first and second members 17A and 17B press the flexible tube 16 radially inward and the ridges 171A and 171B bite into an outer peripheral surface of the flexible tube 16. Thus, the first and second members 17A and 17B hold the flexible tube 16 while restricting movement of the flexible tube 16 in the axial direction of the engagement member 17.

The ridge 171B of the second member 17B is offset from the ridges 171A of the first member 17A in the axial direction of the engagement member 17 in order to reduce the possibility that the flexible tube 16 is torn off due to a load being applied to the same position in the axial direction when the flexible tube 16 is pulled in the axial direction. The first and second members 17A and 17B may have the same structure.

Figure 32:
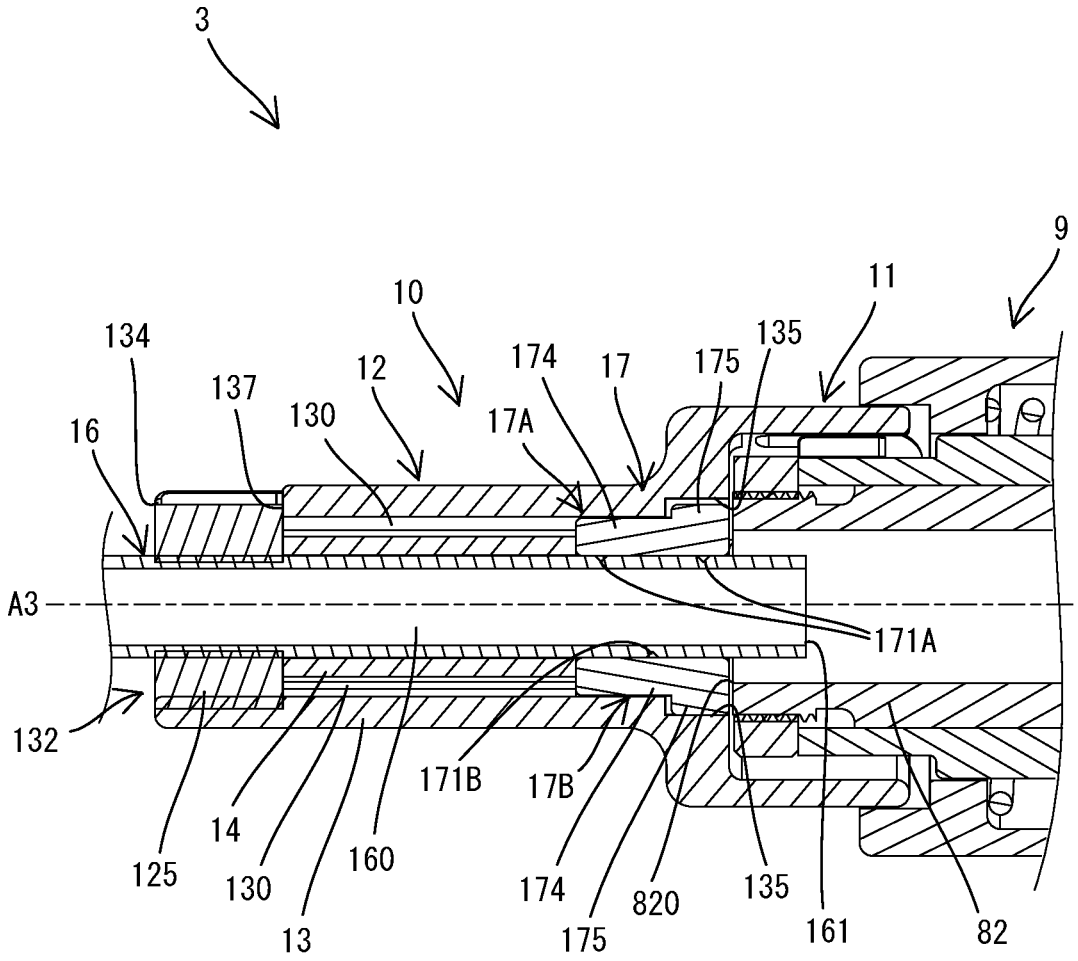
FIG. 32 is a partial, sectional view of the air duster body with the nozzle attached thereto.
Figure 33:
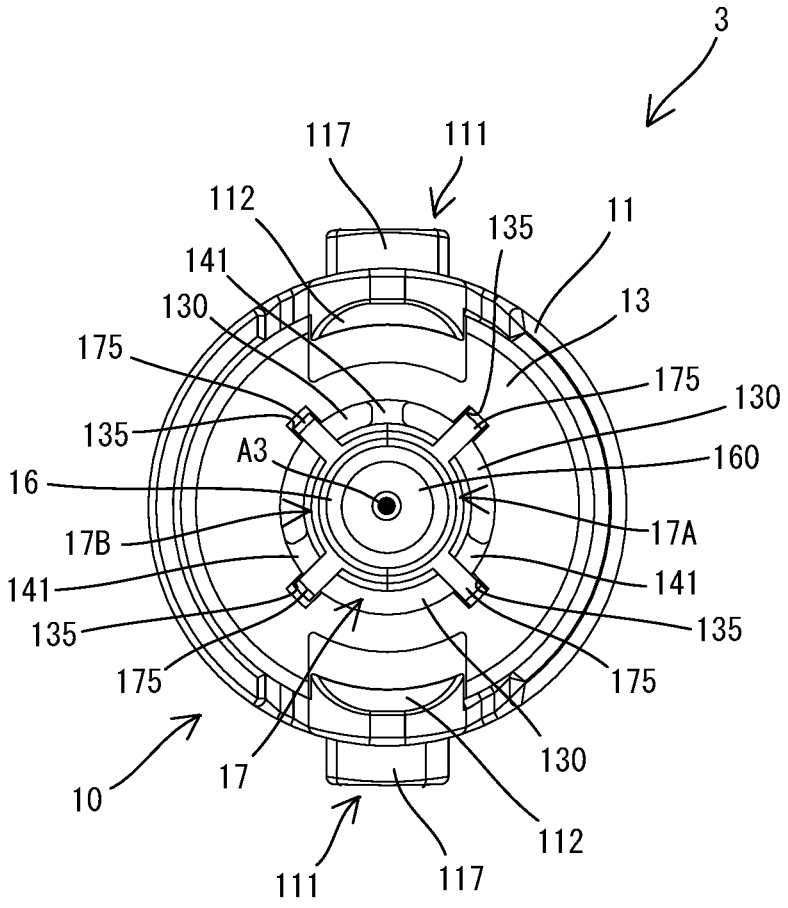
FIG. 33 is a back view of the nozzle.
Figure 34:
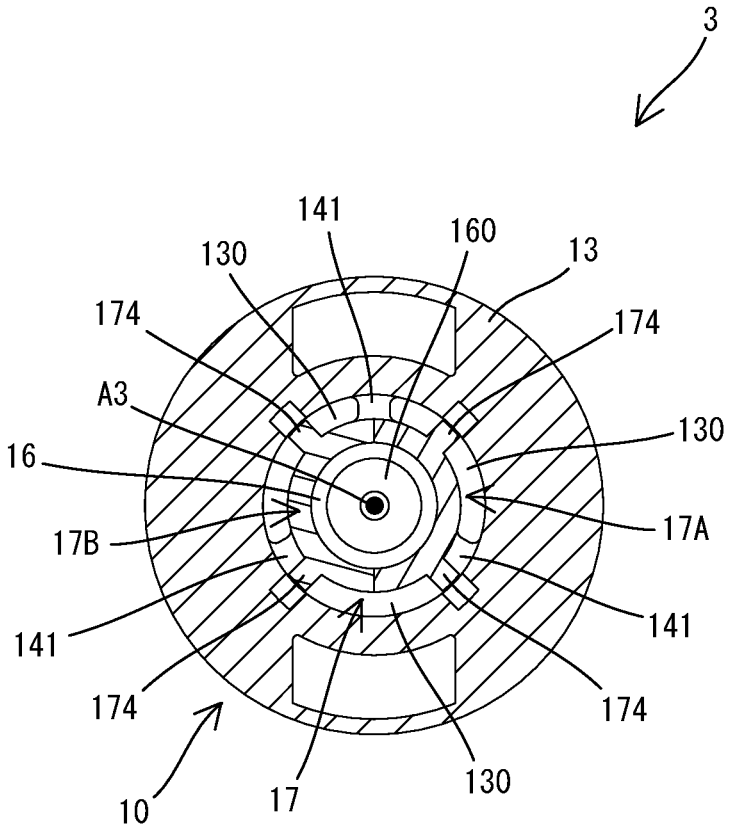
FIG. 34 is a sectional view taken along line XXXIV-XXXIV in FIG. 27.
Figure 35:
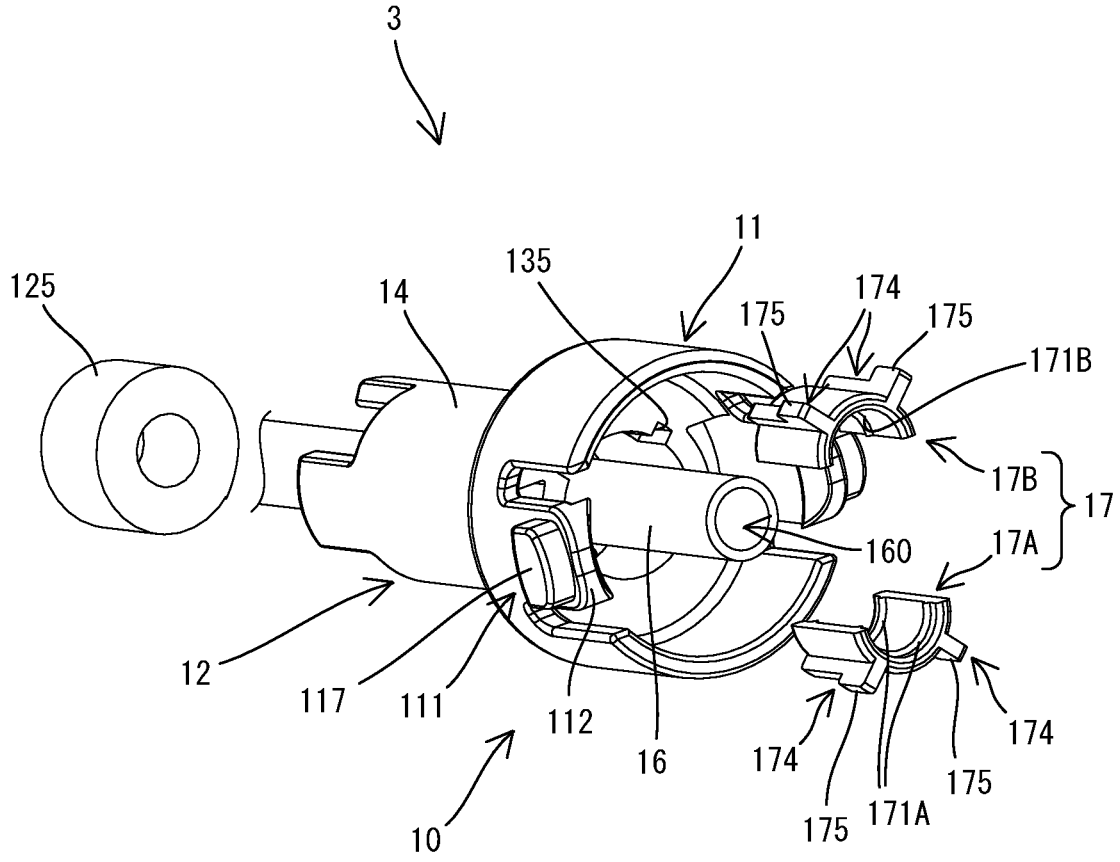
FIG. 35 is an exploded perspective view of the nozzle.

Further, each of the first and second members 17A and 17B has two projections 174 protruding radially outward from an outer peripheral surface thereof. When the first and second members 17A and 17B are put together, the four projections 174 are arranged at equal intervals in the circumferential direction. A rear end portion 175 of each of the projections 174 protrudes radially outward of the other portion of the projection 174, and is configured to be fitted in the recess 135 of the outer tube 13 as shown in FIGS. 32 and 33. The other portion of the projection 174 is configured to be fitted into the outer tube 13 as shown in FIGS. 32 and 34. The length of the projection 174 in the front-rear direction is substantially equal to the distance from the rear end of the inner tube 14 to the rear end of the outer tube 13. The first and second members 17A and 17B are positioned in the circumferential direction, with the base end portion of the flexible tube 16 held therebetween, such that the rear end portions 175 of the projections 174 are respectively aligned with the recesses 135, and then fitted into the rear end portion of the outer tube 13. In the front-rear direction, the first and second members 17A and 17B are each disposed in positions where the front ends of the projections 174 abut on (contact) the rear end of the inner tube 14. Thus, the inner tube 14 prevents forward movement of the engagement member 17.

With the above-described connecting structure, the flexible tube 16 is connected to the holding part 12 via the engagement member 17 so as not to come off forward from the holding part 12. As shown in FIG. 32, when the nozzle 3 is attached to the air duster body 8, a front end of the nozzle part 82 of the air duster body 8 abuts on (contacts) a rear end of the engagement member 17 and prevents rearward movement of the engagement member 17. When the nozzle 3 is not attached to the air duster body 8 as shown in FIG. 28, the user can pull and remove the flexible tube 16 rearward out of the holding part 12 together with the engagement member 17. Therefore, the user can use a flexible tube having a different length and/or a different inner diameter from the flexible tube 16 as necessary by attaching it to the holding part 12 via the engagement member 17.

Further, the nozzle 3 of this embodiment has a structure for preventing surge. Specifically, in addition to the discharge opening 162, a vent hole (vent opening) 132 is formed in the nozzle 3 to increase the flow rate.

As shown in FIGS. 28 and 32, in addition to the discharge opening 162, the nozzle 3 has the vent hole 132 formed radially outward of the flexible tube 16. The vent hole 132 is configured to have a function of preventing surge.

More specifically, as shown in FIGS. 28, 32 and 34, a vent passage 130 is formed radially outward of the flexible tube 16 and connected to the vent hole 132. The vent passage 130 extends in the front-rear direction in the outer tube 13. The vent passage 130 is formed by a first space that is defined between the outer tube 13 and the engagement member 17 behind the rear end of the inner tube 14, a second space that is defined between the outer tube 13 and the inner tube 14, and a third, annular space that is defined between the front end portion of the outer tube 13 and the flexible tube 16 in front of the front end of the inner tube 14. In this embodiment, when the nozzle 3 is attached to the air duster body 8, the air blown out by the centrifugal fan 885 of the air duster body 8 flows into the nozzle 3 from a rear end opening of the vent passage 130 (hereinafter referred to as an inlet opening 131), flows through the vent passage 130, and is discharged from the vent hole 132. In this embodiment, the vent hole 132 is formed by a front end opening 134 and the above-described three openings 137 of the outer tube 13.

Further, in this embodiment, a ventilation resistance member 125 (airflow resistance member) is disposed in a front end portion of the vent passage 130 (the above-described third (annular) space between the front end portion of the outer tube 13 and the flexible tube 16). The ventilation resistance member 125 is configured to reduce the flow velocity of air by serving as resistance while allowing the air to pass through the ventilation resistance member 125. In this embodiment, an open-celled synthetic resin (polymer) (such as a polyurethane sponge) is used as the ventilation resistance member 125. The ventilation resistance member 125 has a hollow cylindrical shape and is fitted into the front end portion of the outer tube 13 with the flexible tube 16 inserted therethrough. The ventilation resistance member 125 is held in a slightly compressed state between the flexible tube 16 and the outer tube 13. The axial length of the ventilation resistance member 125 is substantially equal to the length of the openings 137 formed in the cylindrical wall of the outer tube 13 in the front-rear direction.

With such arrangement, when the air duster body 8 is operated, the air flows into the vent passage 130 from the rear end inlet opening 131 of the outer tube 13 and passes through the vent passage 130 and the ventilation resistance member 125 and then flows out from the vent hole 132 to the front and radially outward of the outer tube 13. The total flow rate of the air discharged from the discharge opening 162 and the air flowing out through the vent hole 132 via the ventilation resistance member 125 is set to be outside the surge region, so that surge is not caused.

In this embodiment, the flow velocity of the air flowing out through the vent hole 132 is reduced while passing through the ventilation resistance member 125. Therefore, the pressure (wind pressure) of the air flowing out through the vent hole 132 is reduced, compared with a structure not having the ventilation resistance member 125. Thus, the ventilation resistance member 125 can prevent high-pressure air from being blown from the vent hole 132 to an unintended position. Further, the flow rate of the air flowing out through the vent hole 132 is reduced, compared with a structure not having the ventilation resistance member 125. Therefore, in this embodiment, the area of the vent hole 132 is set to be larger than that of the structure not having the ventilation resistance member 125. Specifically, the area of the vent hole 132 is increased by provision of the three openings 137 in addition to the front end opening 134 of the outer tube 13, so that the required increase of the flow rate can be achieved.

Thus, the nozzle 3 of this embodiment does not cause surge when the air duster is operated with the nozzle 3 connected to the air duster body 8. Further, if the vent hole 132 is closed and air is not discharged from the vent hole 132, the nozzle 3 causes surge.

According to this embodiment, surge can be prevented when the nozzle 3 is used with the air duster body 8. The nozzle 3 is configured such that the user can relatively freely change the position of the discharge opening 162, depending on a desired position to blow compressed air. Therefore, according to this embodiment, the air duster is provided with a high degree of freedom in operation.

Further, by using the nozzle 3 having the ventilation resistance member 125, the user can prevent high-pressure air from being blown from the vent hole 132 to an unintended position. Further, the nozzle 3 has substantially the same structure as the nozzle 4 of the first embodiment except for the above-described points. Thus, this embodiment also has the same effects as the above-described effects (E1) to (E5), (E9) and (E10) of the first embodiment.

Sixth Embodiment

A nozzle 7 according to the sixth embodiment of the present disclosure is described with reference to FIGS. 36 and 37. The nozzle 7 is another example of the nozzles that can be attached to the air duster body 8. The nozzle 7 of this embodiment is different from the nozzle 3 (see FIGS. 31 and 32) of the fifth embodiment in the structure of connecting the flexible tube 16 and the base member 10. In the other points, the nozzle 7 has the same structure as the nozzle 3.

Figure 36:
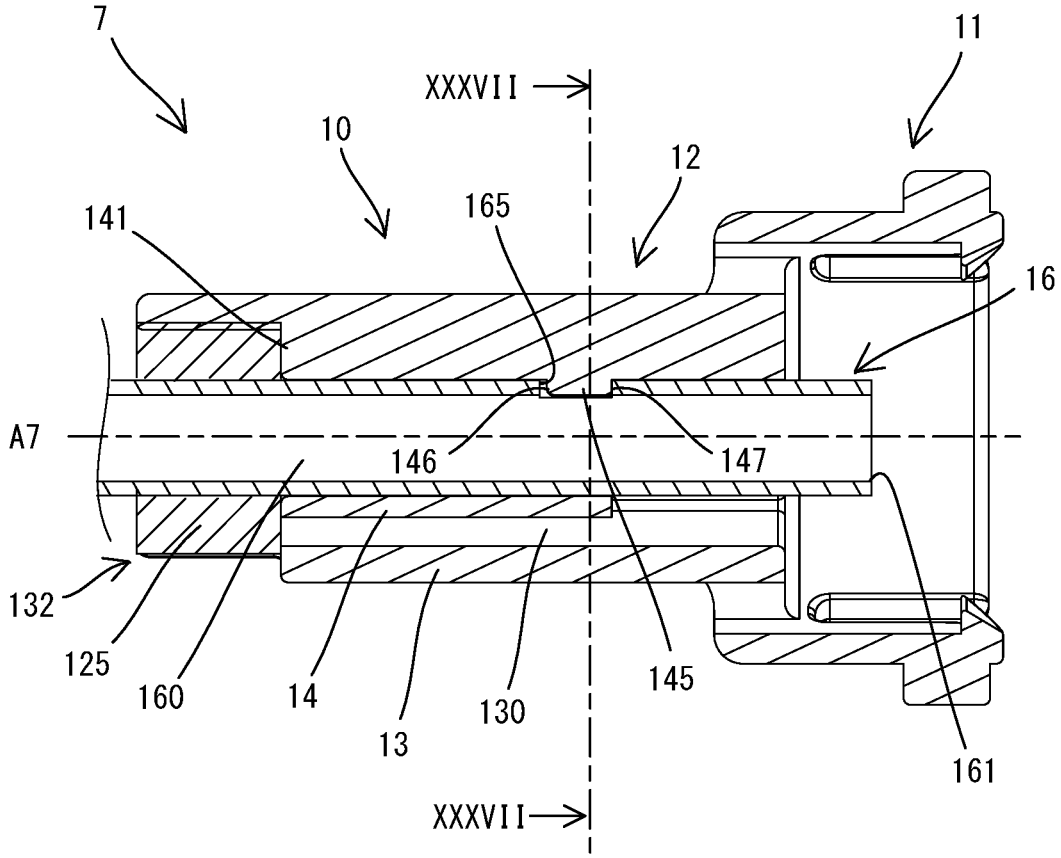
FIG. 36 is a partial, sectional view of a nozzle according to a sixth embodiment.
Figure 37:
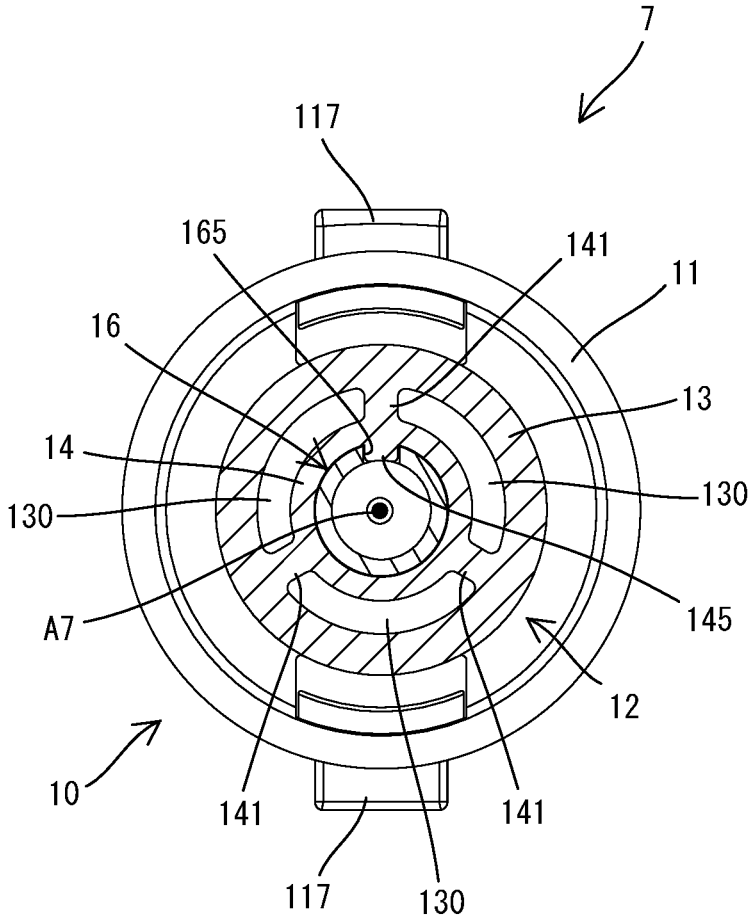
FIG. 37 is a sectional view taken along line XXXVII-XXXVII in FIG. 36.

As shown in FIGS. 36 and 37, like the nozzle 3, the nozzle 7 includes the base member 10, which includes the mounting part 11 and the holding part 12, and the flexible tube 16 connected to the base member 10. The holding part 12 includes the outer tube 13 and the inner tube 14 connected to the outer tube 13 by the ribs 141. In this embodiment, a locking projection 145 is formed on a rear end portion of the inner tube 14. The locking projection 145 protrudes radially inward from an inner peripheral surface of the inner tube 14. The locking projection 145 has a generally rectangular shape and is generally parallel to an axis A7 of the nozzle 7. The locking projection 145 has a front end surface formed as a gently curved surface 146 and a rear end surface formed as an orthogonal surface 147 that extends substantially orthogonal to the axis A7. In this embodiment, only one such locking projection 145 is formed in the same position as one of the three ribs 141 in the circumferential direction around the axis A7.

In this embodiment, a locking hole 165 is formed in the flexible tube 16, instead of the engagement member 17 fitted around the flexible tube 16. The locking hole 165 is a through hole in which the locking projection 145 can be fitted. More specifically, the locking hole 165 has a rectangular shape having substantially the same width in the circumferential direction as the locking projection 145 and having a slightly larger length in the front-rear direction than the locking projection 145.

When assembling the nozzle 7, the locking hole 165 and the locking projection 145 are aligned with each other in the circumferential direction and then the flexible tube 16 is inserted into the inner tube 14 from the front of the base member 10. Then, owing to the curved surface 146, which is the front end surface of the locking projection 145, the rear end of the flexible tube 16 elastically deforms when the rear end comes into contact with the curved surface 146 and is smoothly moved rearward of the locking projection 145. When the flexible tube 16 is placed in (at) a position where the locking hole 165 faces the locking projection 145, the locking projection 145 fits in the locking hole 165, so that the flexible tube 16 is connected to the base member 10 (the holding part 12). The position of the locking hole 165 in the length direction of the flexible tube 16 is set such that the base end portion of the flexible tube 16 protrudes rearward from the rear end of the outer tube 13 when the flexible tube 16 is connected to the base member 10.

As described above, like the nozzle 4 of the fifth embodiment, the nozzle 7 of this embodiment is configured such that the position and orientation of the discharge opening 162 relative to the air duster body 8 can be relatively freely changed. Further, having a smaller number of components than the nozzle 4, the nozzle 7 is less expensive and easier to assemble. Moreover, the orthogonal face 147, which is the rear end face of the locking projection 145, can effectively reduce the possibility that the flexible tube 16 comes off forward from the holding member 12 (the base member 10) due to discharge of the air. Further, the nozzle 7 of this embodiment has the same structure as the nozzle 4 of the fifth embodiment except for the above-described points. Thus, this embodiment also has the same effects as the fifth embodiment.

Correspondences between the features of the above-described embodiments and the features of the disclosure are as follows. The features of the above-described embodiments are, however, merely exemplary and do not limit the features of the present disclosure.

The air duster 1 is an example of the "blower". The air duster body 8 is an example of the "blower body". The inlet opening 810 is an example of the "inlet opening". The body housing 81 is an example of the "housing". The motor 881 is an example of the "motor". The centrifugal fan 885 is an example of the "fan". The nozzles 2 to 7 are examples of the "nozzle". The discharge openings 162, 222, 432, 522, 622 are examples of the "discharge opening". The vent holes 24, 132, 451, 527, 627 are examples of the "vent hole (vent opening)". The cylindrical walls 225, 523, 623 are examples of the "side portion". The vent passages 130, 450, 526, 626 are examples of the "vent passages". The passage 281 is an example of the "passage". The object 28 is an example of the "inflatable object". The projection 280 is an example of the "projection". The ventilation resistance member 125 is an example of the "ventilation resistance member". The lock mechanism 9 is an example of the "lock mechanism".

The above-described embodiments are mere examples of the disclosure and a blower according to the present disclosure is not limited to the air duster 1 of the above-described embodiments. Further, a nozzle according to the present disclosure is not limited to the nozzles 2 to 7 of the above-described embodiments. For example, the following modifications may be made. Further, at least one of these modifications may be employed in combination with any one of the air duster 1, the nozzles 2 to 7 of the above-described embodiment and the claimed features.

For example, the nozzle connected to the air duster body 8 may have at least one vent hole (vent opening) in a different position from the discharge opening. The at least one vent hole need not necessarily be configured such that the total flow rate of air discharged from the discharge opening and from the at least one vent hole of the nozzle is outside the surge region defined according to the specifications of the air duster body 8. Provision of the at least one vent hole in the nozzle can increase the total flow rate of the air discharged from the inside of the nozzle to the outside and thereby suppress surge (reduce the possibility of surge).

In a case where the speed of the motor 881 of the air duster body 8 (the rotation speed of the centrifugal fan 885) is variable, the characteristic curve differs according to the speed of the motor 881. Therefore, the areas of the discharge opening 162 and the at least one vent hole 132 may preferably be set such that the total flow rate is always outside the surge region whichever speed of the motor 881 is selected within a settable range.

The position, number and shape of the vent hole(s) are not limited to those of the above-described embodiments. For example, the vent hole(s) and the discharge opening of the nozzle may be arranged at the same position in the axial direction. For example, the nozzle may have a plurality of vent holes that are different in shape. The shape of the nozzle as a whole, components of the nozzle, the diameter of the discharge opening, and materials of the nozzle are not limited to those of the above-described embodiments and may be appropriately changed.

For example, each of the nozzles 2 to 4 and 7 may be integrally formed with the nozzle part 82 of the air duster body 8. The air duster 1 need not necessarily have the lock mechanism 9, and the nozzles 2 to 7 may be attached to the air duster body 8 by other connecting structures. For example, the nozzles 2 to 7 and the air duster body 8 may be configured to be threadedly engaged with each other.

The air duster body 8 may house a plurality of fans. For example, the air duster body 8 may house fans arranged in multiple stages.

The ventilation resistance member 125 described in the fifth embodiment may be applied to the nozzles 2 and 4 to 7 of the above-described first to fourth and sixth embodiments. In this case, like in the fifth embodiment, the total area of the vent holes may be increased to compensate for reduction of the flow rate of the air discharged from the vent holes that is caused by the ventilation resistance member 125.

The power source of the air duster 1 is not limited to the rechargeable battery 835, but may be a disposable battery. The motor 881 may be a motor with a brush.

Further, in view of the nature of the present disclosure, the above-described embodiments and the modifications thereto, the following aspects are provided. At least one of the following aspects can be employed in combination with at least one of the above-described embodiments and modifications and the claimed features.

(Aspect 1)

An area of the discharge opening is set such that a flow rate of the air discharged only from the discharge opening is within a surge region defined according to specifications of the blower body, and a total area of the at least one vent hole and the discharge opening is set such that the total flow rate of air discharged from the discharge opening and from the at least one vent hole is outside the surge region.

(Aspect 2)

The at least one vent hole includes a plurality of vent holes.

(Aspect 3)

A nozzle configured to be attached to an electric blower, the nozzle comprising:

a mounting part configured to be attached to the blower; and a body part connected to the mounting part and having a discharge opening and a passage for air blown out by the blower, the passage leading to the discharge opening, wherein the body part includes a flexible tube having a length of at least 15 cm and defining at least a portion of the passage.

(Aspect 4)

The flexible tube is coupled to the mounting part such that the flexible tube is prevented from coming off from the mounting part in a flow direction of the air.

(Aspect 5)

The nozzle further includes a cover that at least partially covers the flexible tube, and the cover is formed of a material having higher hardness than the flexible tube and removably coupled to the flexible tube.

(Aspect 6)

The body part has at least one vent hole arranged radially outside of the flexible tube.

(Aspect 7)

A nozzle configured to be attached to an electric blower, the nozzle comprising:

a mounting part configured to be attached to the blower; and a tubular body part protruding from the mounting part and having a discharge opening and at least one vent hole, wherein:

the discharge opening is formed at a protruding end of the body part, and the vent hole is formed in a side portion of the body part and extends to the protruding end of the body part such that the vent hole communicates with the discharge opening.

(Aspect 8)

A stopper is provided inside o the body part and configured to abut on a projection when the projection is inserted into the body part through the discharge opening, and a length of the at least one vent hole in an extending direction of the body part is longer than a distance from the discharge opening to the stopper in the extending direction of the body part.

(Aspect 9) A connecting structure between a blower body and a nozzle, wherein an attaching operation is to linearly move the nozzle toward the blower body in the first direction.

DESCRIPTION OF THE REFERENCE NUMERALS

1: air duster, 2, 3, 4, 5, 6, 7: nozzle, 8: air duster body, 9: lock mechanism, 10: base member, 11: mounting part, 12: holding part, 13: outer tube, 14: inner tube, 16: flexible tube, 17: engagement member, 17A: first member, 17B: second member, 18: cover, 22: body part, 23: stopper, 24: vent hole, 28: object, 42: body part, 43: first cylindrical wall, 44: second cylindrical wall, 45: connecting part, 52: body part, 62: body part, 81: body housing, 82: nozzle part, 83: handle, 89: nut, 91: lock sleeve, 93: slide sleeve, 95: biasing spring, 111: locking piece, 112: claw, 113: front end surface, 114: rear end surface, 115: inclined surface, 117: actuation projection, 118: rear end surface, 125: ventilation resistance member, 130: vent passage, 131: inlet opening, 132: vent hole, 134: opening, 135: recess, 137: opening, 141: rib, 145: locking projection, 146: curved face, 147: orthogonal face, 160: passage, 161: inlet opening, 162: discharge opening, 165: locking hole, 171A: ridge, 171B: ridge, 174: projection, 175: rear end part, 220: passage, 221: inlet opening, 222: discharge opening, 225: cylindrical wall, 231: pin, 280: projection, 281: passage, 282: inlet opening, 283: discharge opening, 285: plug, 287: valve, 430: passage, 431: inlet opening, 432: discharge opening, 440: passage, 450: vent passage, 451: vent hole, 520: passage, 521: inlet opening, 522: discharge opening, 523: cylindrical wall, 524: circular cylindrical part, 525: conical cylindrical part, 526: vent passage, 527: vent hole, 620: passage, 621: inlet opening, 622: discharge opening, 623: cylindrical wall, 626: vent passage, 627: vent hole, 810: inlet opening, 811: cylindrical part, 813: front cover, 814: shoulder part, 820: discharge opening, 831: trigger, 832: switch, 835: battery, 881: motor, 882: output shaft, 885: centrifugal fan, 913: locking groove, 915: guide part, 916: inclined surface, 917: release groove, 931: spring receiving part, 935: receiving recess, 936: abutment surface, 938: restricting part, A0: rotational axis, A1, A2, A3, A4, A5, A6, A7: axis

The invention claimed is:

1. A blower, comprising:

a blower body including a housing having an air inlet opening;

a motor and at least one fan (i) housed in the housing and (ii) configured to draw air into the housing through the air inlet opening; and a nozzle (i) connected to the blower body, (ii) having a straight, center longitudinal axis in an axial direction, (iii) having a cylindrical wall at a forwardmost portion of the nozzle in an intended direction of air flow through the nozzle, the cylindrical wall having only one discharge opening in a forwardmost end of the cylindrical wall, (iv) having at least one vent hole separate from the discharge opening, and (v) configured to discharge air blown out of the blower body to an outside, wherein the straight, center longitudinal axis is a center axis of the cylindrical wall and the only one discharge opening, the blower is configured such that air passing through the only one discharge opening is directly discharged to ambient air, and the at least one vent hole has a vent hole longitudinal axis that is parallel to the straight, center longitudinal axis.

2. The blower as defined in claim 1, wherein:

the housing, the motor, the fan and the nozzle are configured such that (i) a discharge opening flow rate of the air discharged only from the only one discharge opening causes surge when a static pressure of the discharged air decreases with a decrease in the discharge opening flow rate and (ii) a total flow rate of the air discharged from both the at least one vent hole and the only one discharge opening does not cause the surge when the static pressure of the discharged air decreases with a decrease in the total flow rate.

3. The blower as defined in claim 2, wherein the blower is configured to discharge compressed air.

4. The blower as defined in claim 2, wherein the nozzle is configured such that the surge does not occur when the only one discharge opening and the at least one vent hole are open and the surge occurs when the only one discharge opening is open and the at least one vent hole is closed.

5. The blower as defined in claim 1, wherein the at least one vent hole is radially outward of the only one discharge opening.

6. The blower as defined in claim 1, wherein the at least one vent hole is open in the same direction as the only one discharge opening in the axial direction.

7. The blower as defined in claim 1, wherein:

the nozzle includes a hollow conical cylinder having an outer diameter decreasing toward the only one discharge opening, and the at least one vent hole is in a side wall of the hollow conical cylinder.

8. The blower as defined in claim 1, wherein the at least one vent hole is in a side wall of the nozzle and extends to the forwardmost end of the nozzle such that the at least one vent hole communicates with the only one discharge opening.

9. The blower as defined in claim 8, wherein:

the nozzle has a passage that connects the blower body and the only one discharge opening, the only one discharge opening is configured to receive a tubular air injection projection on an inflatable object, a portion of the at least one vent hole is configured to provide communication between an inside and an outside of the passage without being closed by the projection when the projection is inserted into the passage through the only one discharge opening, and the inflatable object, the projection, the only one discharge opening and the at least one vent hole are configured such that (i) a projection flow rate of the air discharged into the inflatable object from the projection via the only one discharge opening causes surge when a static pressure of the discharged air decreases with a decrease in the projection flow rate and (ii) a total flow rate of the air discharged to the outside of the passage from the portion of the vent hole and the air discharged into the inflatable object from the projection via the only one discharge opening does not cause surge when a static pressure of the discharged air decreases with a decrease in the total flow rate.

10. The blower as defined in claim 1, wherein the at least one vent hole is between the only one discharge opening and the blower body in the axial direction.

11. The blower as defined in claim 1, wherein the at least one fan is a single fan.

12. The blower as defined in claim 1, further comprising:

a ventilation resistance member removably disposed in a vent passage extending to the at least one vent hole.

13. The blower as defined in claim 1, wherein the nozzle is removably attachable to the blower body.

14. The blower as defined in claim 13, further comprising:

a lock mechanism, wherein:

the lock mechanism is configured to be actuated when the nozzle is moved in a first direction relative to the blower body in response to a user's manipulation of attaching the nozzle to the blower body and to lock the nozzle in an attachment position to be immovable in a second direction opposite to the first direction when the nozzle is placed in the attachment position relative to the blower body.

15. The blower as defined in claim 1, wherein the at least one vent hole includes a plurality of vent holes.

16. The blower as defined in claim 1, wherein:

the cylindrical wall is a first cylindrical wall;

the nozzle includes a second cylindrical wall rearward of the first cylindrical wall;

a first cylindrical wall inner diameter of the first cylindrical wall is smaller than a second cylindrical inner diameter of the second cylindrical wall;

the first cylindrical wall and the second cylindrical wall are connected by a connecting part; and the at least one vent hole is defined by an inner surface of the first cylindrical wall and an outer surface of the second cylindrical wall.

17. The blower as defined in claim 1, wherein:

the motor and the at least one fan have a rotation axis; and the straight, center longitudinal axis of the nozzle is coaxial with the rotation axis.

18. A nozzle (i) configured to be connected to a blower body and (ii) having a straight, center longitudinal axis extending in an axial direction, the nozzle comprising:

a cylindrical wall at a forwardmost portion of the nozzle in an intended direction of air flow through the nozzle, the cylindrical wall having only one discharge opening in a forwardmost end of the cylindrical wall; and at least one vent hole separate from the only one discharge opening, wherein the straight, center longitudinal axis is a center axis of the cylindrical wall and the only one discharge opening, and the at least one vent hole has a vent hole longitudinal axis that is parallel to the straight, center longitudinal axis.

19. The nozzle according to claim 18, wherein:

the cylindrical wall is a first cylindrical wall;

the nozzle includes a second cylindrical wall rearward of the first cylindrical wall;

a first cylindrical wall inner diameter of the first cylindrical wall is smaller than a second cylindrical inner diameter of the second cylindrical wall;

the first cylindrical wall and the second cylindrical wall are connected by a connecting part; and the at least one vent hole is defined by an inner surface of the first cylindrical wall and an outer surface of the second cylindrical wall.

* * * * *